US009959826B2

(12) United States Patent
Tanaka et al.

(10) Patent No.: US 9,959,826 B2
(45) Date of Patent: May 1, 2018

(54) LIQUID CRYSTAL DISPLAY DEVICE

(71) Applicant: Sharp Kabushiki Kaisha, Osaka-shi, Osaka (JP)

(72) Inventors: Yuta Tanaka, Osaka (JP); Akizumi Fujioka, Osaka (JP); Kazuki Takahashi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 93 days.

(21) Appl. No.: 14/900,782

(22) PCT Filed: Feb. 27, 2014

(86) PCT No.: PCT/JP2014/054896
§ 371 (c)(1),
(2) Date: Dec. 22, 2015

(87) PCT Pub. No.: WO2014/208130
PCT Pub. Date: Dec. 31, 2014

(65) Prior Publication Data

US 2016/0140923 A1 May 19, 2016

(30) Foreign Application Priority Data

Jun. 27, 2013 (JP) ..... 2013-135618

(51) Int. Cl.
*G09G 3/36* (2006.01)

(52) U.S. Cl.
CPC ..... *G09G 3/3648* (2013.01); *G09G 3/3655* (2013.01); *G09G 2310/04* (2013.01);
(Continued)

(58) Field of Classification Search
CPC ..... G09G 2330/022; G09G 3/3655; G09G 3/3648; G09G 2310/08; G09G 2310/04; G09G 2320/0257
See application file for complete search history.

(56) References Cited

U.S. PATENT DOCUMENTS 6,067,645 A 5/2000 Yamamoto et al.
2002/0093473 A1 7/2002 Tanaka et al.
(Continued)

FOREIGN PATENT DOCUMENTS

CN 102714221 A 10/2012
JP 08-328516 A 12/1996
(Continued)

OTHER PUBLICATIONS

Official Communication issued in International Patent Application No. PCT/JP2014/054896, dated May 20, 2014.

*Primary Examiner* — Abhishek Sarma
(74) *Attorney, Agent, or Firm* — Keating & Bennett, LLP

(57) ABSTRACT

A liquid crystal display device is provided where deterioration of the liquid crystal panel is prevented while reducing power consumption. A liquid crystal panel (12) includes a display region (26) in which a video is displayed. The display region (26) includes a plurality of sub-regions (26A, 26B, 26C, 26D). A drive unit (14) rewrites the display on at least one of the plurality of sub-regions (26A, 26B, 26C, 26D) based on a video signal. An identification unit (38) identifies the one of the plurality of sub-regions (26A, 26B, 26C, 26D) on which the drive unit (14) has not rewritten the display for a predetermined number of frames. An output unit (40) outputs an interrupt signal for requesting a video signal for rewriting the display on the sub-region identified by the identification unit.

8 Claims, 44 Drawing Sheets

(52) U.S. Cl.
CPC . *G09G 2310/08* (2013.01); *G09G 2320/0257* (2013.01); *G09G 2330/022* (2013.01)

(56) References Cited

U.S. PATENT DOCUMENTS

| | | | | |
|---|---|---|---|---|
| 2002/0180673 | A1 | 12/2002 | Tsuda et al. | |
| 2012/0062529 | A1 | 3/2012 | Koyama | |
| 2012/0206461 | A1* | 8/2012 | Wyatt | G09G 5/003 345/501 |
| 2012/0298988 | A1 | 11/2012 | Hara et al. | |
| 2014/0125569 | A1 | 5/2014 | Nakata et al. | |
| 2015/0022506 | A1* | 1/2015 | Takahashi | G06F 3/147 345/204 |

FOREIGN PATENT DOCUMENTS

| | | | |
|---|---|---|---|
| JP | 2001-312253 | A | 11/2001 |
| JP | 2002-278523 | A | 9/2002 |
| JP | 2005-140958 | A | 6/2005 |
| JP | 2012-256012 | A | 12/2012 |
| WO | 2013/008668 | A1 | 1/2013 |

* cited by examiner

| | Nth FRAME | N+1th FRAME | N+2th FRAME | N+3th FRAME | N+4th FRAME | N+5th FRAME |
|---|---|---|---|---|---|---|
| OPERATION OF OUTPUT UNIT 40 | | | | SIGNAL OUTPUT | SIGNAL OUTPUT | |
| OPERATION OF VIDEO SIGNAL SUPPLY UNIT 28 (SUB-REGION 26A) | SIGNAL OUTPUT | SIGNAL OUTPUT | IDLE IN OUTPUTTING SIGNAL | IDLE IN OUTPUTTING SIGNAL | SIGNAL OUTPUT | SIGNAL OUTPUT |
| OPERATION OF DRIVE UNIT 14 (SUB-REGION 26A) | DISPLAY REWRITE | DISPLAY REWRITE | IDLE IN REWRITING DISPLAY | IDLE IN REWRITING DISPLAY | DISPLAY REWRITE | DISPLAY REWRITE |
| OPERATION OF VIDEO SIGNAL SUPPLY UNIT 28 (SUB-REGION 26B) | SIGNAL OUTPUT | IDLE IN OUTPUTTING SIGNAL | SIGNAL OUTPUT | SIGNAL OUTPUT | SIGNAL OUTPUT | SIGNAL OUTPUT |
| OPERATION OF DRIVE UNIT 14 (SUB-REGION 26B) | DISPLAY REWRITE | IDLE IN REWRITING DISPLAY | DISPLAY REWRITE | DISPLAY REWRITE | DISPLAY REWRITE | DISPLAY REWRITE |
| OPERATION OF VIDEO SIGNAL SUPPLY UNIT 28 (SUB-REGION 26C) | SIGNAL OUTPUT | SIGNAL OUTPUT | IDLE IN OUTPUTTING SIGNAL | SIGNAL OUTPUT | SIGNAL OUTPUT | SIGNAL OUTPUT |
| OPERATION OF DRIVE UNIT 14 (SUB-REGION 26C) | DISPLAY REWRITE | DISPLAY REWRITE | IDLE IN REWRITING DISPLAY | DISPLAY REWRITE | DISPLAY REWRITE | DISPLAY REWRITE |
| OPERATION OF VIDEO SIGNAL SUPPLY UNIT 28 (SUB-REGION 26D) | SIGNAL OUTPUT | IDLE IN OUTPUTTING SIGNAL | SIGNAL OUTPUT | IDLE IN OUTPUTTING SIGNAL | SIGNAL OUTPUT | SIGNAL OUTPUT |
| OPERATION OF DRIVE UNIT 14 (SUB-REGION 26D) | DISPLAY REWRITE | IDLE IN REWRITING DISPLAY | DISPLAY REWRITE | IDLE IN REWRITING DISPLAY | DISPLAY REWRITE | DISPLAY REWRITE |

FIG. 7B

| | Nth FRAME | N+1th FRAME | N+2th FRAME | N+3th FRAME | N+4th FRAME | N+5th FRAME |
|---|---|---|---|---|---|---|
| OPERATION OF OUTPUT UNIT 40 | | | SIGNAL OUTPUT | | SIGNAL OUTPUT | |
| OPERATION OF VIDEO SIGNAL SUPPLY UNIT 28 (SUB-REGION 26A) | SIGNAL OUTPUT | IDLE IN OUTPUTTING SIGNAL | IDLE IN OUTPUTTING SIGNAL | IDLE IN OUTPUTTING SIGNAL | IDLE IN OUTPUTTING SIGNAL | SIGNAL OUTPUT |
| OPERATION OF DRIVE UNIT 14 (SUB-REGION 26A) | DISPLAY REWRITE | IDLE IN REWRITING DISPLAY | IDLE IN REWRITING DISPLAY | IDLE IN REWRITING DISPLAY | IDLE IN REWRITING DISPLAY | DISPLAY REWRITE |
| OPERATION OF VIDEO SIGNAL SUPPLY UNIT 28 (SUB-REGION 26B) | SIGNAL OUTPUT | IDLE IN OUTPUTTING SIGNAL | SIGNAL OUTPUT | SIGNAL OUTPUT | SIGNAL OUTPUT | SIGNAL OUTPUT |
| OPERATION OF DRIVE UNIT 14 (SUB-REGION 26B) | DISPLAY REWRITE | IDLE IN REWRITING DISPLAY | DISPLAY REWRITE | DISPLAY REWRITE | DISPLAY REWRITE | DISPLAY REWRITE |
| OPERATION OF VIDEO SIGNAL SUPPLY UNIT 28 (SUB-REGION 26C) | SIGNAL OUTPUT | SIGNAL OUTPUT | IDLE IN OUTPUTTING SIGNAL | SIGNAL OUTPUT | IDLE IN OUTPUTTING SIGNAL | SIGNAL OUTPUT |
| OPERATION OF DRIVE UNIT 14 (SUB-REGION 26C) | DISPLAY REWRITE | DISPLAY REWRITE | IDLE IN REWRITING DISPLAY | DISPLAY REWRITE | IDLE IN REWRITING DISPLAY | DISPLAY REWRITE |
| OPERATION OF VIDEO SIGNAL SUPPLY UNIT 28 (SUB-REGION 26D) | SIGNAL OUTPUT | IDLE IN OUTPUTTING SIGNAL | SIGNAL OUTPUT | IDLE IN OUTPUTTING SIGNAL | SIGNAL OUTPUT | SIGNAL OUTPUT |
| OPERATION OF DRIVE UNIT 14 (SUB-REGION 26D) | DISPLAY REWRITE | IDLE IN REWRITING DISPLAY | DISPLAY REWRITE | IDLE IN REWRITING DISPLAY | DISPLAY REWRITE | DISPLAY REWRITE |

FIG. 15B

| | Nth FRAME | N+1th FRAME | N+2th FRAME | N+3th FRAME | N+4th FRAME | N+5th FRAME |
|---|---|---|---|---|---|---|
| OPERATION OF OUTPUT UNIT 40 | | | SIGNAL OUTPUT | | | |
| OPERATION OF VIDEO SIGNAL SUPPLY UNIT 28 (SUB-REGION 26A) | SIGNAL OUTPUT | IDLE IN OUTPUTTING SIGNAL | IDLE IN OUTPUTTING SIGNAL | IDLE IN OUTPUTTING SIGNAL | IDLE IN OUTPUTTING SIGNAL | IDLE IN OUTPUTTING SIGNAL |
| OPERATION OF DRIVE UNIT 14 (SUB-REGION 26A) | DISPLAY REWRITE | IDLE IN REWRITING DISPLAY | IDLE IN REWRITING DISPLAY | IDLE IN REWRITING DISPLAY | BLACK DISPLAY | IDLE IN REWRITING DISPLAY |
| OPERATION OF VIDEO SIGNAL SUPPLY UNIT 28 (SUB-REGION 26B) | SIGNAL OUTPUT | IDLE IN OUTPUTTING SIGNAL | SIGNAL OUTPUT | SIGNAL OUTPUT | SIGNAL OUTPUT | SIGNAL OUTPUT |
| OPERATION OF DRIVE UNIT 14 (SUB-REGION 26B) | DISPLAY REWRITE | IDLE IN REWRITING DISPLAY | DISPLAY REWRITE | DISPLAY REWRITE | BLACK DISPLAY | DISPLAY REWRITE |
| OPERATION OF VIDEO SIGNAL SUPPLY UNIT 28 (SUB-REGION 26C) | SIGNAL OUTPUT | SIGNAL OUTPUT | IDLE IN OUTPUTTING SIGNAL | SIGNAL OUTPUT | IDLE IN OUTPUTTING SIGNAL | SIGNAL OUTPUT |
| OPERATION OF DRIVE UNIT 14 (SUB-REGION 26C) | DISPLAY REWRITE | DISPLAY REWRITE | IDLE IN REWRITING DISPLAY | DISPLAY REWRITE | BLACK DISPLAY | DISPLAY REWRITE |
| OPERATION OF VIDEO SIGNAL SUPPLY UNIT 28 (SUB-REGION 26D) | SIGNAL OUTPUT | IDLE IN OUTPUTTING SIGNAL | SIGNAL OUTPUT | IDLE IN OUTPUTTING SIGNAL | SIGNAL OUTPUT | SIGNAL OUTPUT |
| OPERATION OF DRIVE UNIT 14 (SUB-REGION 26D) | DISPLAY REWRITE | IDLE IN REWRITING DISPLAY | DISPLAY REWRITE | IDLE IN REWRITING DISPLAY | BLACK DISPLAY | DISPLAY REWRITE |

FIG. 17B

| | Nth FRAME | N+1th FRAME | N+2th FRAME | N+3th FRAME | N+4th FRAME | N+5th FRAME |
|---|---|---|---|---|---|---|
| OPERATION OF OUTPUT UNIT 40 | | | SIGNAL OUTPUT | | | |
| OPERATION OF VIDEO SIGNAL SUPPLY UNIT 28 (SUB-REGION 26A) | SIGNAL OUTPUT | IDLE IN OUTPUTTING SIGNAL | IDLE IN OUTPUTTING SIGNAL | IDLE IN OUTPUTTING SIGNAL | IDLE IN OUTPUTTING SIGNAL | IDLE IN OUTPUTTING SIGNAL |
| OPERATION OF DRIVE UNIT 14 (SUB-REGION 26A) | DISPLAY REWRITE | IDLE IN REWRITING DISPLAY | IDLE IN REWRITING DISPLAY | IDLE IN REWRITING DISPLAY | BLACK DISPLAY | BLACK DISPLAY |
| OPERATION OF VIDEO SIGNAL SUPPLY UNIT 28 (SUB-REGION 26B) | SIGNAL OUTPUT | IDLE IN OUTPUTTING SIGNAL | SIGNAL OUTPUT | SIGNAL OUTPUT | SIGNAL OUTPUT | SIGNAL OUTPUT |
| OPERATION OF DRIVE UNIT 14 (SUB-REGION 26B) | DISPLAY REWRITE | IDLE IN REWRITING DISPLAY | DISPLAY REWRITE | DISPLAY REWRITE | BLACK DISPLAY | BLACK DISPLAY |
| OPERATION OF VIDEO SIGNAL SUPPLY UNIT 28 (SUB-REGION 26C) | SIGNAL OUTPUT | SIGNAL OUTPUT | IDLE IN OUTPUTTING SIGNAL | SIGNAL OUTPUT | IDLE IN OUTPUTTING SIGNAL | SIGNAL OUTPUT |
| OPERATION OF DRIVE UNIT 14 (SUB-REGION 26C) | DISPLAY REWRITE | DISPLAY REWRITE | IDLE IN REWRITING DISPLAY | DISPLAY REWRITE | BLACK DISPLAY | BLACK DISPLAY |
| OPERATION OF VIDEO SIGNAL SUPPLY UNIT 28 (SUB-REGION 26D) | SIGNAL OUTPUT | IDLE IN OUTPUTTING SIGNAL | SIGNAL OUTPUT | IDLE IN OUTPUTTING SIGNAL | SIGNAL OUTPUT | SIGNAL OUTPUT |
| OPERATION OF DRIVE UNIT 14 (SUB-REGION 26D) | DISPLAY REWRITE | IDLE IN REWRITING DISPLAY | DISPLAY REWRITE | IDLE IN REWRITING DISPLAY | BLACK DISPLAY | BLACK DISPLAY |

FIG. 19B

| | Nth FRAME | N+1th FRAME | N+2th FRAME | N+3th FRAME | N+4th FRAME | N+5th FRAME |
|---|---|---|---|---|---|---|
| OPERATION OF OUTPUT UNIT 40 | SIGNAL OUTPUT | | | | | |
| OPERATION OF VIDEO SIGNAL SUPPLY UNIT 28 (SUB-REGION 26A) | IDLE IN OUTPUTTING SIGNAL | IDLE IN OUTPUTTING SIGNAL | IDLE IN OUTPUTTING SIGNAL | IDLE IN OUTPUTTING SIGNAL | IDLE IN OUTPUTTING SIGNAL | SIGNAL OUTPUT |
| OPERATION OF DRIVE UNIT 14 (SUB-REGION 26A) | IDLE IN REWRITING DISPLAY | IDLE IN REWRITING DISPLAY | BLACK DISPLAY | BLACK DISPLAY | BLACK DISPLAY | DISPLAY REWRITE |
| OPERATION OF VIDEO SIGNAL SUPPLY UNIT 28 (SUB-REGION 26B) | SIGNAL OUTPUT | IDLE IN OUTPUTTING SIGNAL | SIGNAL OUTPUT | SIGNAL OUTPUT | SIGNAL OUTPUT | SIGNAL OUTPUT |
| OPERATION OF DRIVE UNIT 14 (SUB-REGION 26B) | DISPLAY REWRITE | IDLE IN REWRITING DISPLAY | BLACK DISPLAY | BLACK DISPLAY | BLACK DISPLAY | DISPLAY REWRITE |
| OPERATION OF VIDEO SIGNAL SUPPLY UNIT 28 (SUB-REGION 26C) | SIGNAL OUTPUT | SIGNAL OUTPUT | IDLE IN OUTPUTTING SIGNAL | SIGNAL OUTPUT | IDLE IN OUTPUTTING SIGNAL | SIGNAL OUTPUT |
| OPERATION OF DRIVE UNIT 14 (SUB-REGION 26C) | DISPLAY REWRITE | DISPLAY REWRITE | BLACK DISPLAY | BLACK DISPLAY | BLACK DISPLAY | DISPLAY REWRITE |
| OPERATION OF VIDEO SIGNAL SUPPLY UNIT 28 (SUB-REGION 26D) | SIGNAL OUTPUT | IDLE IN OUTPUTTING SIGNAL | SIGNAL OUTPUT | IDLE IN OUTPUTTING SIGNAL | SIGNAL OUTPUT | SIGNAL OUTPUT |
| OPERATION OF DRIVE UNIT 14 (SUB-REGION 26D) | DISPLAY REWRITE | IDLE IN REWRITING DISPLAY | BLACK DISPLAY | BLACK DISPLAY | BLACK DISPLAY | DISPLAY REWRITE |

FIG. 21B

| | Nth FRAME | N+1th FRAME | N+2th FRAME | N+3th FRAME | N+4th FRAME | N+5th FRAME |
|---|---|---|---|---|---|---|
| OPERATION OF OUTPUT UNIT 40 | | | SIGNAL OUTPUT | | | |
| OPERATION OF VIDEO SIGNAL SUPPLY UNIT 28 (SUB-REGION 26A) | SIGNAL OUTPUT | IDLE IN OUTPUTTING SIGNAL | IDLE IN OUTPUTTING SIGNAL | IDLE IN OUTPUTTING SIGNAL | IDLE IN OUTPUTTING SIGNAL | IDLE IN OUTPUTTING SIGNAL |
| OPERATION OF DRIVE UNIT 14 (SUB-REGION 26A) | DISPLAY REWRITE | IDLE IN REWRITING DISPLAY | IDLE IN REWRITING DISPLAY | IDLE IN REWRITING DISPLAY | GND POTENTIAL | IDLE IN REWRITING DISPLAY |
| OPERATION OF VIDEO SIGNAL SUPPLY UNIT 28 (SUB-REGION 26B) | SIGNAL OUTPUT | IDLE IN OUTPUTTING SIGNAL | SIGNAL OUTPUT | SIGNAL OUTPUT | SIGNAL OUTPUT | SIGNAL OUTPUT |
| OPERATION OF DRIVE UNIT 14 (SUB-REGION 26B) | DISPLAY REWRITE | IDLE IN REWRITING DISPLAY | DISPLAY REWRITE | DISPLAY REWRITE | GND POTENTIAL | DISPLAY REWRITE |
| OPERATION OF VIDEO SIGNAL SUPPLY UNIT 28 (SUB-REGION 26C) | SIGNAL OUTPUT | SIGNAL OUTPUT | IDLE IN OUTPUTTING SIGNAL | SIGNAL OUTPUT | IDLE IN OUTPUTTING SIGNAL | SIGNAL OUTPUT |
| OPERATION OF DRIVE UNIT 14 (SUB-REGION 26C) | DISPLAY REWRITE | DISPLAY REWRITE | IDLE IN REWRITING DISPLAY | DISPLAY REWRITE | GND POTENTIAL | DISPLAY REWRITE |
| OPERATION OF VIDEO SIGNAL SUPPLY UNIT 28 (SUB-REGION 26D) | SIGNAL OUTPUT | IDLE IN OUTPUTTING SIGNAL | SIGNAL OUTPUT | IDLE IN OUTPUTTING SIGNAL | SIGNAL OUTPUT | SIGNAL OUTPUT |
| OPERATION OF DRIVE UNIT 14 (SUB-REGION 26D) | DISPLAY REWRITE | IDLE IN REWRITING DISPLAY | DISPLAY REWRITE | IDLE IN REWRITING DISPLAY | GND POTENTIAL | DISPLAY REWRITE |

FIG. 23B

LIQUID CRYSTAL DISPLAY DEVICE

TECHNICAL FIELD

The present invention relates to a liquid crystal display device.

BACKGROUND ART

Liquid crystal display devices for displaying video on their liquid crystal panels are known. In a liquid crystal display device, a video is displayed on the liquid crystal panel based on video signals provided by the host to the timing controller (including, for example, vertical synchronization signals, horizontal synchronization signals and video data signals).

In recent years, there have been demands for reduced power consumption in liquid crystal display devices. One approach to reducing the power consumption of a liquid crystal display device is a driving method called idled driving.

During idled driving, drive periods and idle periods are repeated in an alternate manner. A drive period is a period during which a plurality of scan lines are consecutively selected and scanned to write a signal voltage. An idle period is a period during which all the scan lines are placed in the non-selected state and no signal voltage is written.

Idled driving involves periods during which no signal voltage is written, reducing power consumption. Such idled driving is disclosed in JP 2001-312253 A, for example.

DISCLOSURE OF THE INVENTION

However, if the idle periods are too long, the liquid crystal panel may deteriorate.

In another approach to reducing the power consumption of a liquid crystal display device, for example, no video signal may be provided by the host to the timing controller when the video displayed on the liquid crystal panel does not change. In this case, providing the liquid crystal display device with a frame memory for storing video data signals for refreshing display means an increase in the manufacturing costs of the liquid crystal display device.

An object of the present invention is to provide a liquid crystal display device where deterioration of the liquid crystal panel is prevented while reducing power consumption and cutting manufacturing costs.

A liquid crystal display device in an embodiment of the present invention includes a liquid crystal panel and displays a video on the liquid crystal panel based on a video signal that has been received. The liquid crystal panel includes a display region on which the video is displayed. The display region includes a plurality of sub-regions. The liquid crystal display device further includes a drive unit, an identification unit and an output unit. The drive unit rewrites a display on at least one of the plurality of sub-regions based on the video signal. The identification unit identifies at least one of the plurality of sub-regions on which the drive unit has not rewritten a display for a predetermined number of frames. The output unit outputs an interrupt signal for requesting a video signal for rewriting the display on the sub-region identified by the identification unit.

In a liquid crystal display device in an embodiment of the present invention, deterioration of the liquid crystal panel is prevented while reducing power consumption and cutting manufacturing costs.

BRIEF DESCRIPTION OF THE DRAWINGS

FIG. 7B is a timing chart illustrating how the output unit, video signal supply unit and drive unit operate when the video displayed on the display region changes as illustrated in FIG. 7A.

FIG. 15B is a timing chart illustrating how the output unit, video signal supply unit and drive unit operate when the video displayed on the display region changes as illustrated in FIG. 15A.

FIG. 17B is a timing chart illustrating how the output unit, video signal supply unit and drive unit operate when the video displayed on the display region changes as illustrated in FIG. 17A.

FIG. 19B is a timing chart illustrating how the output unit, video signal supply unit and drive unit operate when the video displayed on the display region changes as illustrated in FIG. 19A.

FIG. 21B is a timing chart illustrating how the output unit, video signal supply unit and drive unit operate when the video displayed on the display region changes as illustrated in FIG. 21A.

FIG. 23B is a timing chart illustrating how the output unit, video signal supply unit and drive unit operate when the video displayed on the display region changes as illustrated in FIG. 23A.

EMBODIMENTS FOR CARRYING OUT THE INVENTION

Figure 1:
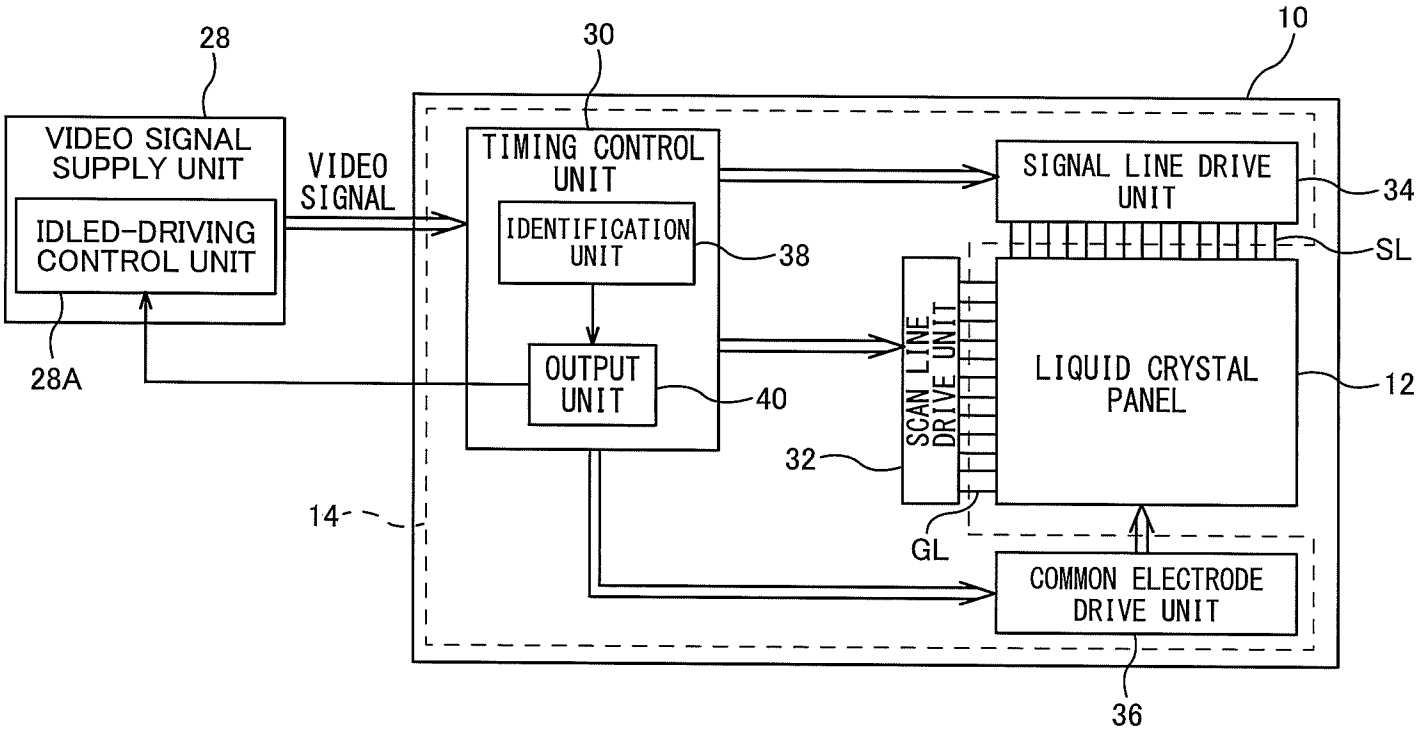
FIG. 1 is a block diagram schematically illustrating a liquid crystal display device in a first embodiment of the present invention.

A liquid crystal display device in a first aspect of the present invention includes a liquid crystal panel and displays a video on the liquid crystal panel based on a video signal that has been received. The liquid crystal panel includes a display region on which the video is displayed. The display region includes a plurality of sub-regions. The liquid crystal display device further includes a drive unit, an identification unit and an output unit. The drive unit rewrites a display on at least one of the plurality of sub-regions based on the video signal. The identification unit identifies at least one of the plurality of sub-regions on which the drive unit has not rewritten a display for a predetermined number of frames. The output unit outputs an interrupt signal for requesting a video signal for rewriting the display on the sub-region identified by the identification unit.

In the above aspect, the drive unit rewrites the display on at least one sub-region based on a video signals that has been received. That is, the drive unit does not rewrite the display on the sub-region if it has received no video signal. Thus, the above aspect will reduce power consumption.

If the period during which no video signal is provided is too long, the liquid crystal panel may deteriorate. Thus, to prevent the liquid crystal panel from deteriorating, it is preferable that such a period is not too long.

In the above aspect, the identification unit identifies one of the sub-regions on which the drive unit has not rewritten the display for a predetermined number of frames. The output unit outputs an interrupt signal for requesting a video signal for rewriting the display on the sub-region identified by the identification unit. This will increase the likelihood of the display on the sub-region identified by the identification unit being rewritten. Thus, the liquid crystal panel will be less likely to deteriorate.

Moreover, no frame memory needs to be provided, thus minimizing the manufacturing costs.

In a liquid crystal display device in a second aspect of the present invention, starting from the liquid crystal display device in the first aspect, the drive unit rewrites the display on the sub-region identified by the identification unit for a plurality of frames.

In a liquid crystal panel, a voltage that depends on a video signal is applied to a storage capacitor to display a video corresponding to the video signal. The storage capacitance, Clc, may be represented by the following Equation (1):

$$Clc=\in\times(S/d) \quad (1),$$

where $\in$ is the dielectric constant of a liquid crystal, S is the area of a pixel electrode, and d is the distance between the pixel electrode and the common electrode. A liquid crystal has a property called dielectric anisotropy. The dielectric constant $\in$ varies depending on the orientation of liquid crystal molecules. That is, the dielectric constant $\in$ varies depending on gray scale level.

In a liquid crystal panel, liquid crystal molecules are oriented in a direction that depends on the voltage applied to the storage capacitor (i.e. applied voltage). A certain period of time is required until liquid crystal molecules reach the orientation that corresponds to the applied voltage. If the writing period is too short, the orientation of liquid crystal molecules cannot follow the changes in the applied voltage within the writing period such that changes in the storage capacitance delay relative to changes in the applied voltage. Thus, at the time point where the writing period finishes, the storage capacitance has not yet reached the level required to display the intended gray scale level, and the applied voltage may decrease depending on the change in the storage capacitance. This may cause a difference between the originally intended applied voltage and the actually applied voltage, which may be perceived as an afterimage on the screen.

In the above aspect, the display on the sub-region identified by the identification unit is rewritten a plurality of times. Thus, for example, even if the storage capacitance has not reached the level required for display after a first rewrite, it will reach the level required to display the intended gray scale level after a second or a subsequent rewrite. This will prevent an afterimage from being produced.

In a liquid crystal display device in a third aspect of the present invention, starting from the liquid crystal display device in the second aspect, the drive unit rewrites the display on the sub-region identified by the identification unit in each of a plurality of consecutive frames.

The above aspect will reduce the time period required until the storage capacitance required to display the intended gray scale level is reached.

In a liquid crystal display device in a fourth aspect of the present invention, starting from the liquid crystal display device in any one of the first to third aspects, the drive unit rewrites a display on one of the plurality of sub-regions that is other than the sub-region identified by the identification unit in a frame where the display on the sub-region identified by the identification unit is rewritten.

In the above aspect, the display on the sub-regions other than the sub-region identified by the identification unit is rewritten within a predetermined number of frames. Thus, it will be unlikely that there will be a sub-region on which the drive unit has not rewritten the display for a predetermined number of frames. Thus, the liquid crystal panel will be unlikely to deteriorate.

In a liquid crystal display device in a fifth aspect of the present invention, starting from the liquid crystal display device in the first aspect, the output unit outputs an interrupt signal if the display on the sub-region identified by the identification unit has not been rewritten in a predetermined number of frames since the interrupt signal was output.

The above aspect will increase the likelihood of the display on the sub-region identified by the identification unit being rewritten.

In a sixth aspect of the present invention, starting from the liquid crystal display device in the fifth aspect, the output unit outputs an interrupt signal in a predetermined interval until the display on the sub-region identified by the identification unit is rewritten.

The above aspect will prevent the liquid crystal panel from deteriorating more effectively than in implementations where an interrupt signal is output only once.

In the above aspect, the predetermined interval may be one frame, for example, or a plurality of frames.

In a seventh aspect of the present invention, starting from the liquid crystal display device in the first aspect, the drive unit rewrites the display on the sub-region identified by the identification unit into a predetermined gray scale display if the display on the sub-region identified by the identification unit has not been rewritten in a predetermined number of frames since the output unit output the interrupt signal.

The above aspect will prevent the liquid crystal panel from deteriorating even if no video signal for rewriting the display on the sub-region identified by the identification unit is received.

In the above aspect, the predetermined gray scale display may be a black display if the liquid crystal panel is a normally-black liquid crystal panel or white display if the liquid crystal panel is a normally-white liquid crystal panel.

In an eighth aspect of the present invention, starting from the liquid crystal display device in the seventh aspect, the drive unit produces the predetermined gray scale display on the sub-region identified by the identification unit for a plurality of frames.

The above aspect will prevent the liquid crystal panel from deteriorating.

In a ninth aspect of the present invention, starting from the liquid crystal display device in the seventh or eighth aspect, the drive unit produces the predetermined gray scale display on the sub-region identified by the identification unit until it rewrites the display on the sub-region identified by the identification unit based on the video signal for rewriting the display on the sub-region identified by the identification unit.

The above aspect will prevent the liquid crystal panel from deteriorating.

In a tenth aspect of the present invention, starting from the liquid crystal display device in the seventh or eighth aspect, the drive unit produces the predetermined gray scale display on the sub-region identified by the identification unit until the liquid crystal display device is powered off.

The above aspect will prevent the liquid crystal panel from deteriorating.

In a liquid crystal display device in an eleventh aspect of the present invention, starting from the liquid crystal display device in the first aspect, the liquid crystal panel further includes a plurality of pixel units. The plurality of pixel units form the display region. Each of the pixel units includes a thin-film transistor and a storage capacitor. The storage capacitor is connected to the thin-film transistor. The storage capacitor includes a pixel electrode and a common electrode. The pixel electrode is connected to the thin-film transistor. The common electrode is positioned adjacent the pixel electrode. The common electrode includes a plurality of common-electrode sections. The plurality of common-electrode sections are positioned to correspond to the plurality of sub-regions. If the drive unit has not rewritten the display on the sub-region identified by the identification unit in a predetermined number of frames since the output unit output the interrupt signal, the drive unit changes a potential of one of the plurality of common-electrode sections that corresponds to the sub-region identified by the identification unit and a potential of the pixel electrode contained in one of the plurality of pixel units that forms the sub-region identified by the identification unit to a predetermined potential.

The above aspect will prevent the liquid crystal panel from deteriorating even if no video signal for rewriting the display on the sub-region identified by the identification unit is received.

In the above aspect, the predetermined potential may be, for example, the ground potential (i.e. GND potential), or a common potential other than the GND potential.

In a liquid crystal display device in a twelfth aspect of the present invention, starting from the liquid crystal display device in the first aspect, the liquid crystal panel further includes a plurality of pixel units. The plurality of pixel units form the display region. Each of the pixel units includes a thin-film transistor and a storage capacitor. The storage capacitor is connected to the thin-film transistor. The thin-film transistor includes a semiconductor layer made of an oxide semiconductor.

In a liquid crystal display device in a thirteenth aspect of the present invention, starting from the liquid crystal display device in the twelfth aspect, the oxide semiconductor includes indium (In), gallium (Ga), zinc (Zn) and oxide (O).

The above aspect will reduce leak currents compared with implementations where the semiconductor layer is made of silicon.

In a liquid crystal display device in a fourteenth aspect of the present invention, starting from the liquid crystal display device in the thirteenth aspect, the oxide semiconductor is crystalline.

More specific embodiments of the present invention will now be described with reference to the drawings. The same or corresponding components in the drawings are labeled with the same characters and their description will not be repeated.

Embodiments

FIG. 1 is a block diagram illustrating a liquid crystal display device 10 in a first embodiment of the present invention. The liquid crystal display device 10 may be used to display video in a mobile device such as a smartphone or tablet, cell phone, TV set or notebook computer, for example. The liquid crystal display device 10 includes a liquid crystal panel 12 and a drive unit 14.

Figure 2:
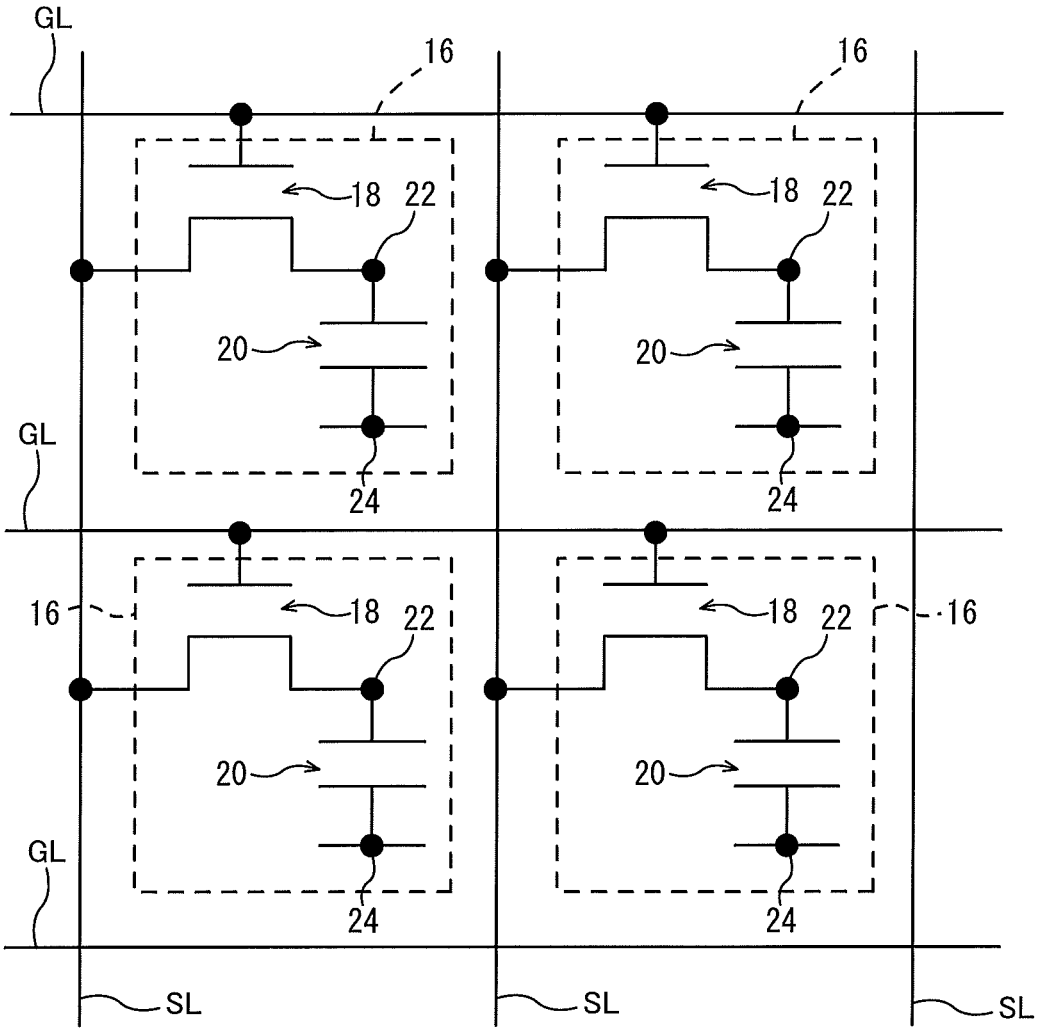
FIG. 2 is an equivalent circuit diagram illustrating pixels of the liquid crystal panel of the liquid crystal display device of FIG. 1.

The liquid crystal panel 12 will be described with reference to FIG. 2. The liquid crystal panel 12 includes a plurality of scan line GL and a plurality of signal lines SL. The signal lines SL cross the scan lines GL. A pixel unit 16 is positioned at the intersection of each of the scan lines GL and each of the signal lines SL. That is, the liquid crystal panel 12 includes a plurality of pixel units 16. As used herein, "a pixel unit 16 is positioned at the intersection of a scan line GL and a signal line SL" also means that a pixel unit 16 is positioned near the intersection of a scan line GL and a signal line SL.

The pixel unit 16 includes a thin-film transistor 18 and a storage capacitor 20.

The thin-film transistor 18 has a gate electrode connected to the associated scan line GL, a source electrode connected to the associated signal line SL, and a drain electrode connected to the storage capacitor 20.

The thin-film transistor 18 may include a semiconductor layer made of silicon; however, the thin-film transistor preferably includes a semiconductor layer made of an oxide semiconductor.

The oxide semiconductor may include an In—Ga—Zn—O-based semiconductor, for example. The In—Ga—Zn—O-based semiconductor is a ternary oxide of indium (In), gallium (Ga) and zinc (Zn), where the ratio between In, Ga and Zi (i.e. composition ratio) is not limited to a particular value, and may be In:Ga:Zn=2:2:1, In:Ga:Zn=1:1:1, or In:Ga:Zn=1:1:2, for example. In the present embodiment, an In—Ga—Zn—O-based semiconductor layer containing In, Ga and Zn in a ratio of 1:1:1 is provided.

A TFT having an In—Ga—Zn—O-based semiconductor layer has a high mobility (more than 20 times that of an a-SiTFT) and a low leak current (less than one hundredth of that of an a-SiTFT), and thus can be suitably used as a driving TFT and pixel TFT. The use of TFTs having an In—Ga—Zn—O-based semiconductor layer significantly reduces the power consumption of the liquid crystal display device 10.

The In—Ga—Zn—O-based semiconductor may be amorphous, or may include crystalline portions and thus be crystalline. A preferable crystalline In—Ga—Zn—O-based semiconductor is a crystalline In—Ga—Zn—O-based semiconductor with its c-axis oriented generally perpendicular to the layer face. The crystalline structure of such an In—Ga—Zn—O-based semiconductor is disclosed, for example, in JP 2012-134475 A. JP 2012-134475 A is incorporated by reference herein in its entirety.

Instead of an In—Ga—Zn—O-based semiconductor, the oxide semiconductor may be another oxide semiconductor, such as a Zn—O-based semiconductor (ZnO), an In—Zn—O-based semiconductor (IZO (registered trademark)), a Zn—Ti—O-based semiconductor (ZTO), a Cd—Ge—O-based semiconductor, a Cd—Pb—O-based semiconductor, cadmium oxide (CdO), an Mg—Zn—O-based semiconductor, an In—Sn—Zn—O-based semiconductor (for example, $In_2O_3$—$SnO_2$—ZnO), or an In—Ga—Sn—O-based semiconductor.

The storage capacitor 20 includes a pixel electrode 22 and a common electrode 24. The pixel electrode 22 is connected to the drain electrode of the thin-film transistor 18. The common electrode 24 is positioned to be adjacent to the pixel electrode 22. A liquid crystal layer is positioned between the pixel electrode 22 and common electrode 24. As a charge corresponding to a signal voltage written via the signal line SL and thin-film transistor 18 is accumulated in the storage capacitor 20, a desired video is displayed on the liquid crystal panel 12.

Returning to FIG. 1, video signals are sent to the liquid crystal display device 10 from the video signal supply unit 28. Video signals may include, for example, horizontal synchronization signals, vertical synchronization signals and video data signals.

The video signal supply unit 28 may provide a video signal as a parallel signal to the drive unit 14 (or, more particularly, timing control unit 30 described below), or may provide a video signal as a differential serial signal. If a video signal is provided as a differential serial signal, the liquid crystal display device 10 further includes an interface for converting a differential serial signal to a parallel signal.

Figure 3:
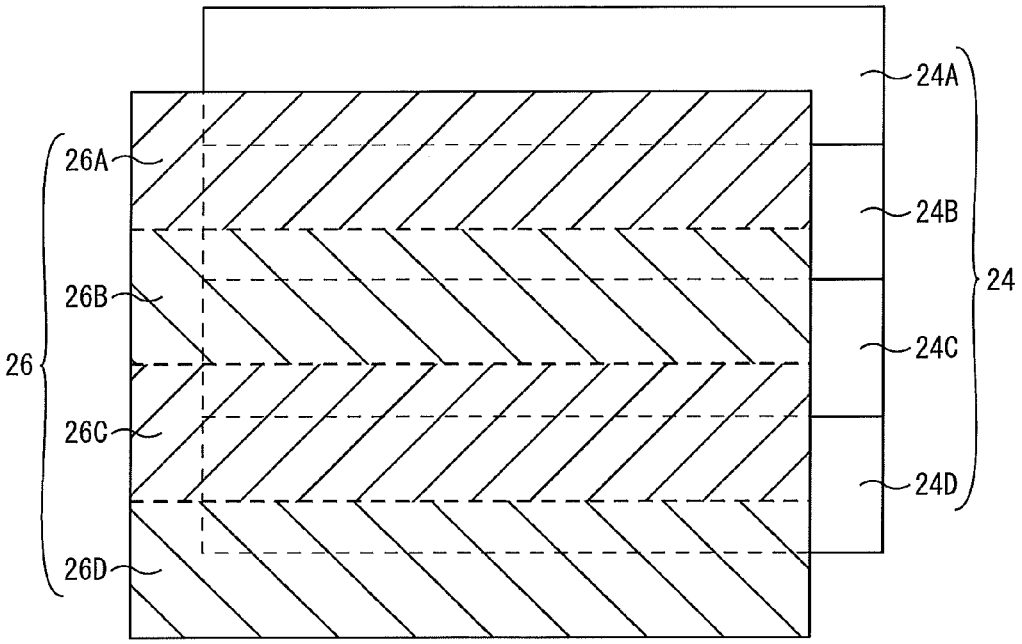
FIG. 3 illustrates the display region of the liquid crystal panel.

Based on the video signal received from the video signal supply unit 28, the drive unit 14 displays a video on a display region 26 (see FIG. 3).

The drive unit 14 includes a timing control unit 30, a scan line drive unit 32, a signal line drive unit 34 and a common electrode drive unit 36.

The timing control unit 30 controls the scan line drive unit 32, signal line drive unit 34 and common electrode drive unit 36 based on video signals received from the video signal supply unit 28.

The scan line drive unit 32 is a gate driver. The scan line drive unit 32 is connected to a plurality of scan lines GL. Based on control signals received from the timing control unit 30, the scan line drive unit 32 consecutively selects the scan lines GL and scan them to control the operation of the thin-film transistors 18.

The signal line drive unit 34 is a source driver. The signal line drive unit 34 is connected to a plurality of signal lines SL. Based on control signals received from the timing control unit 30, the signal line drive unit 34 provides signal voltages to the signal lines SL.

The common electrode drive unit 36 is connected to the common electrode 24 (see FIG. 3). Based on a control signal received from the timing control unit 30, the common electrode drive unit 36 sets the potential of the common electrode 24.

The display region 26 of the liquid crystal panel 12 will be described with reference to FIG. 3. The liquid crystal panel 12 includes the display region 26. The display region 26 includes a plurality of pixel units 16 (see FIG. 2). A video may be displayed on the display region 26.

The display region 26 is divided into four sub-regions 26A, 26B, 26C and 26D. Each of the sub-regions 26A, 26B, 26C and 26D may display a portion of a video displayed on the display region 26, or they may display videos that are unrelated to each other.

The common electrode 24 is made up of a plurality of common-electrode sections 24A, 24B, 24C and 24D corresponding to the four sub-regions 26A, 26B, 26C and 26D that make up the display region 26. The common-electrode sections 24A, 24B, 24C and 24D are positioned to correspond to the sub-regions 26A, 26B, 26C and 26D. More specifically, the common-electrode section 24A is positioned to correspond to the sub-region 26A; the common-electrode section 24B is positioned to correspond to the sub-region 26B; the common-electrode section 24C is positioned to correspond to the sub-region 26C; and the common-electrode section 24D is positioned to correspond to the sub-region 26D.

The video signal supply unit 28 (see FIG. 1) provides a video signal to the drive unit 14 (or, more particularly, timing control unit 30) so as to rewrite the display on one of the sub-regions 26A, 26B, 26C and 26D. That is, a video signal received from the video signal supply unit 28 is at least one of (1) a video signal for rewriting the display on the sub-region 26A, (2) a video signal for rewriting the display on the sub-region 26B, (3) a video signal for rewriting the display on the sub-region 26C, and (4) a video signal for rewriting the display on the sub-region 26D.

The video signal supply unit 28 includes an idled-driving control unit 28A (see FIG. 1). The idled-driving control unit 28A controls the output of video signals by the video signal supply unit 28. More specifically, the idled-driving control unit 28A controls the video signal supply unit 28 so as to provide a video signal for the one of the sub-regions 26A, 26B, 26C and 26D where the video has changed. Thus, the video signal supply unit 28 provides a video signal for rewriting the display on the sub-region 26A (hereinafter referred to as first normal video signal) when the video for the sub-region 26A has changed, provides a video signal for rewriting the display on the sub-region 26B (hereinafter referred to as second normal video signal) when the video for the sub-region 26B has changed, provides a video signal for rewriting the display on the sub-region 26C (hereinafter referred to as third normal video signal) when the video for the sub-region 26C has changed, and provides a video signal for rewriting the display on the sub-region 26D (hereinafter referred to as fourth normal video signal) when the video for the sub-region 26 has changed.

More detailed description will be provided in connection with an example where the video for the sub-region 26A has changed. An example where the video for the sub-region 26A has changed may involve, for example, the pointer of a mouse having moved on the screen of a personal computer.

When the video for the sub-region 26A has changed, a first normal video signal is provided to the timing control unit 30. In this case, based on the first normal video signal, the timing control unit 30 controls the scan line drive unit 32, signal line drive unit 34 and common electrode drive unit 36. More specifically, the scan line drive unit 32 consecutively selects those of the scan lines GL that are connected to the pixel units 16 associated with the sub-region 26A and scans them to control the operation of the thin-film transistors 18 included in these pixel units 16. The signal line drive unit 34 provides signal voltages to the signal lines SL. The common electrode drive unit 36 sets the potential of the common-electrode section 24A. Thus, the display on the sub-region 26A changes.

If the video has not changed, the video signal supply unit 28 provides no normal video signal. In this case, the drive unit 14 maintains the current display. More specifically, the scan line drive unit 32 is idle in consecutively selecting those of the scan lines GL that are connected to the pixel units 16 associated with the sub-region for which the video has not changed and scanning them to control the operation of the thin-film transistors 18 included in these pixel units 16. The signal line drive unit 34 is idle in providing signal voltages to the signal lines SL. The common electrode drive unit 36 maintains the potential of the common-electrode section associated with the sub-region for which the video has not changed.

The timing control unit 30 includes an identification unit 38 and an output unit 40 (see FIG. 1).

The identification unit 38 identifies the one of the sub-regions 26A, 26B, 26C and 26D on which the drive unit 14 has not rewritten the display for a predetermined number of frames (hereinafter referred to as specified sub-region). The identification unit 38 provides to the output unit 40 a control signal indicating that it has identified a specified sub-region. The control signal may include, for example, information indicating the specified sub-region.

The predetermined number of frames may be any length of time period that can prevent deterioration caused by a direct voltage being continuously applied to the liquid crystal in the liquid crystal panel 12. As the identification unit 38 identifies a sub-region on which the display has not been rewritten for a predetermined number of frames, it is possible to identify a sub-region in the liquid crystal panel 12 where deterioration is likely to occur. To determine whether a predetermined number of frames have passed, for example, the identification unit 38 may include a counter and determine whether the count value of the counter has exceeded the value that indicates the predetermined number of frames.

When the identification unit 38 has identified a sub-region, that is, the output unit 40 has received a control signal from the identification unit 38, the output unit provides an interrupt signal to the video signal supply unit 28. This interrupt signal allows the video signal supply unit 28 to recognize in which sub-region in the liquid crystal panel 12 deterioration is likely to occur. As such, the video signal supply unit 28 can take measures to prevent the liquid crystal panel 12 from deteriorating. The interrupt signal is only required to include information indicating a specified sub-region.

When the video signal supply unit 28 has received an interrupt signal, it provides to the drive unit 14 (or, more particularly, timing control unit 30) a video signal for rewriting the display on the specified sub-region indicated by the interrupt signal (hereinafter referred to as refresh video signal). More specifically, if the specified sub-region is the sub-region 26A, the video signal supply unit 28 provides a refresh video signal for rewriting the display on the sub-region 26A (hereinafter referred to as first refresh video signal); if the specified sub-region is the sub-region 26B, it provides a refresh video signal for rewriting the display on the sub-region 26B (hereinafter referred to as second refresh video signal); if the specified sub-region is the sub-region 26C, it provides a refresh video signal for rewriting the display on the sub-region 26C (hereinafter referred to as third refresh video signal); and, if the specified sub-region is the sub-region 26D, it provides a refresh video signal for rewriting the display on the sub-region 26D (hereinafter referred to as fourth refresh video signal).

Based on the refresh video signal received from the video signal supply unit 28, the timing control unit 30 controls the scan line drive unit 32, signal line drive unit 34 and common electrode drive unit 36 to refresh the display on the specified sub-region. More specifically, the scan line drive unit 32 consecutively selects those of the scan lines GL that are connected to the pixel units 16 associated with the specified sub-region and scan them to control the operation of the thin-film transistors 18 included in these pixel units. The signal line drive unit 34 provides signal voltages to the signal lines SL. The common electrode drive unit 36 sets the potential of the common-electrode section corresponding to the specified sub-region such that the polarity of the voltage applied to the storage capacitor 20 is changed. As the polarity is reversed, deterioration of the liquid crystal panel 12 can be prevented.

Now, methods for preventing deterioration of the liquid crystal panel 12 will be described with reference to illustrations and timing charts illustrating how the video for the display region 26 changes from one frame to another. The methods described below are merely examples. The prevention of deterioration of the liquid crystal panel 12 is not limited to the following methods.

Figure 4A:
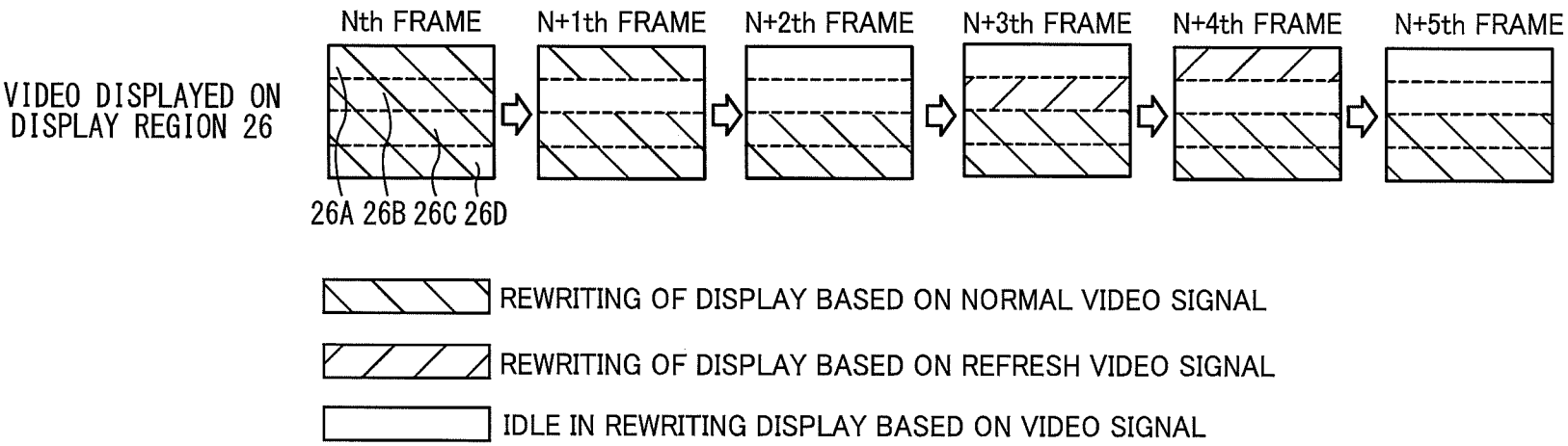
FIG. 4A illustrates how the video displayed on the display region changes from one frame to another in the first embodiment.

FIG. 4A illustrates how the video for the display region 26 changes from one frame to another. FIG. 4A shows sub-regions 26A, 26B, 26C and 26D, where the hatched ones with oblique lines running toward the top left are ones on which the display has been rewritten based on a normal video signal, the hatched ones with oblique lines running toward the top right are ones on which the display has been rewritten based on a refresh video signal, and the unhatched ones are ones on which the display has not been rewritten.

Figure 4B:
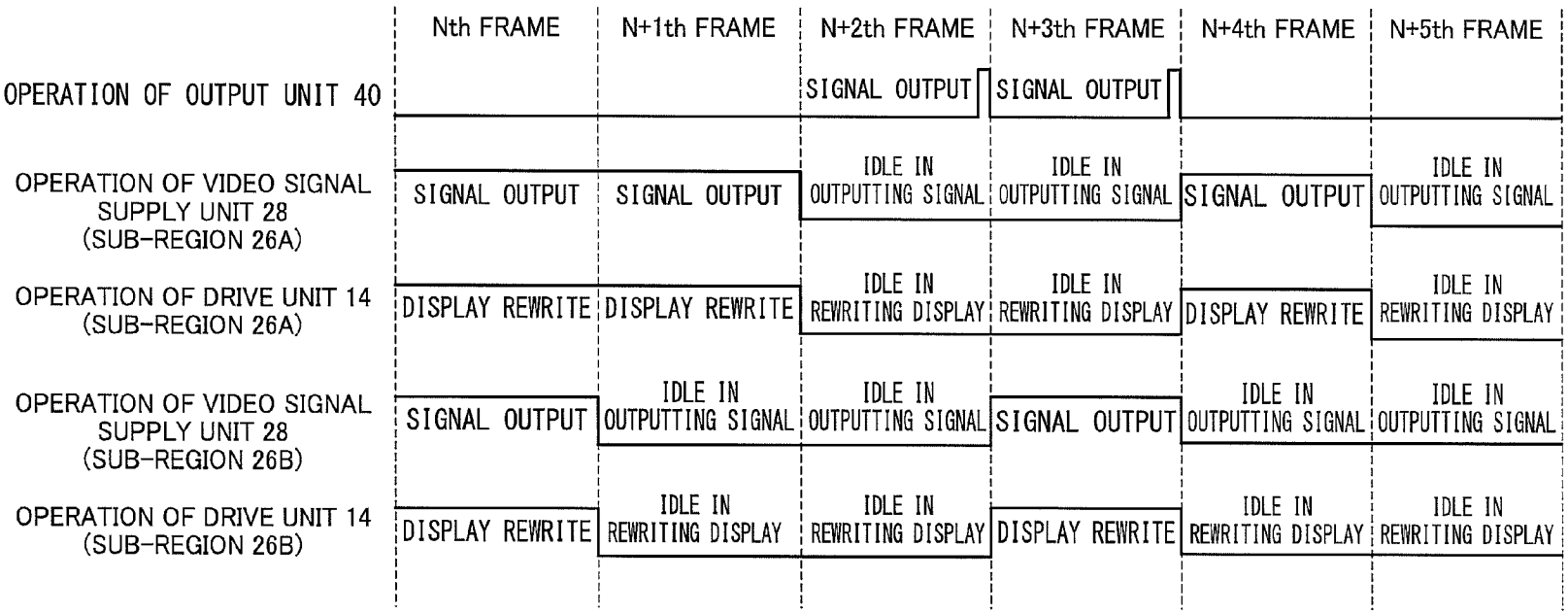
FIG. 4B is a timing chart illustrating how the output unit, video signal supply unit and drive unit operate when the video displayed on the display region changes as illustrated in FIG. 4A.

FIG. 4B is a timing chart illustrating one example method for preventing deterioration of the liquid crystal panel 12 in an implementation where the video for the display region 26 changes as shown in FIG. 4A. The frames shown in FIG. 4B correspond to the frames shown in FIG. 4A. FIG. 4B only shows the portions of a timing chart that are related to the rewriting of the displays on the sub-regions 26A and 26B.

How the display on a specified sub-region is refreshed will be described with reference to FIGS. 4A and 4B. The following description relates to a case where the specified sub-region is the sub-region 26B.

In the N+1th and N+2th frames, the video signal supply unit 28 is idle in providing a second normal video signal to the drive unit 14. Thus, in the N+1th and N+2th frames, the drive unit 14 is idle in rewriting the display on the sub-region 26B. This reduces power consumption.

At the end of the N+2th frame, the output unit 40 provides an interrupt signal to the video signal supply unit 28. Thereafter, in the N+3th frame, the video signal supply unit 28 provides a second refresh video signal to the drive unit 14 to refresh the display on the sub-region 26B. In the N+3th frame, the drive unit 14 refreshes the display on the sub-region 26B. This prevents the liquid crystal panel 12 from deteriorating.

Example Application of First Embodiment

Figure 5A:
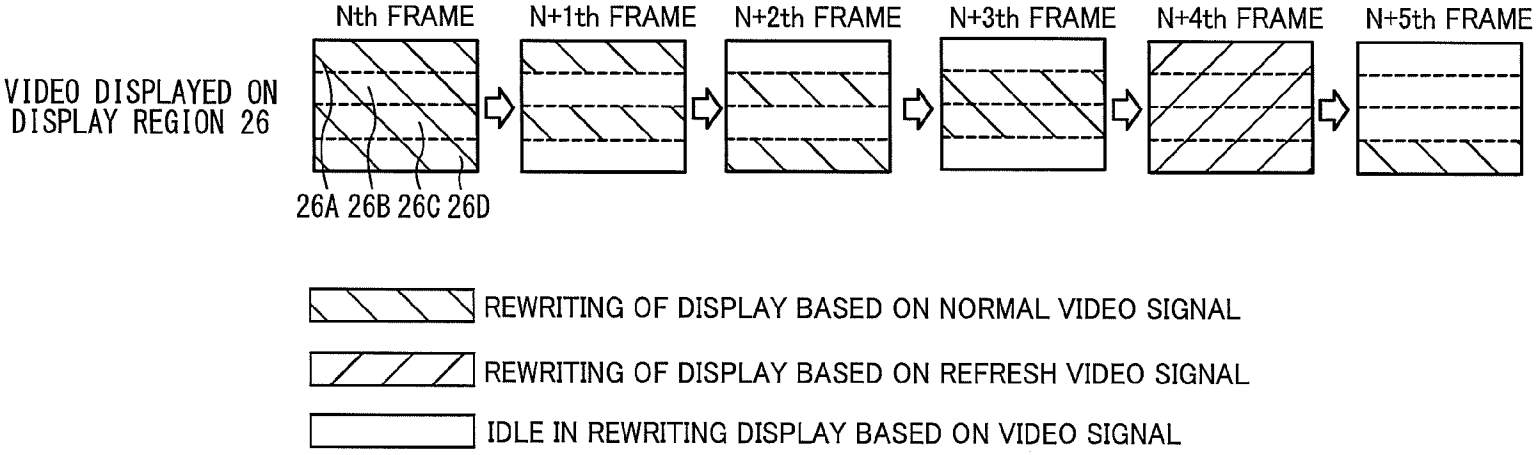
FIG. 5A illustrates how the video displayed on the display region changes from one frame to another in an example application of the first embodiment.
Figure 5B:
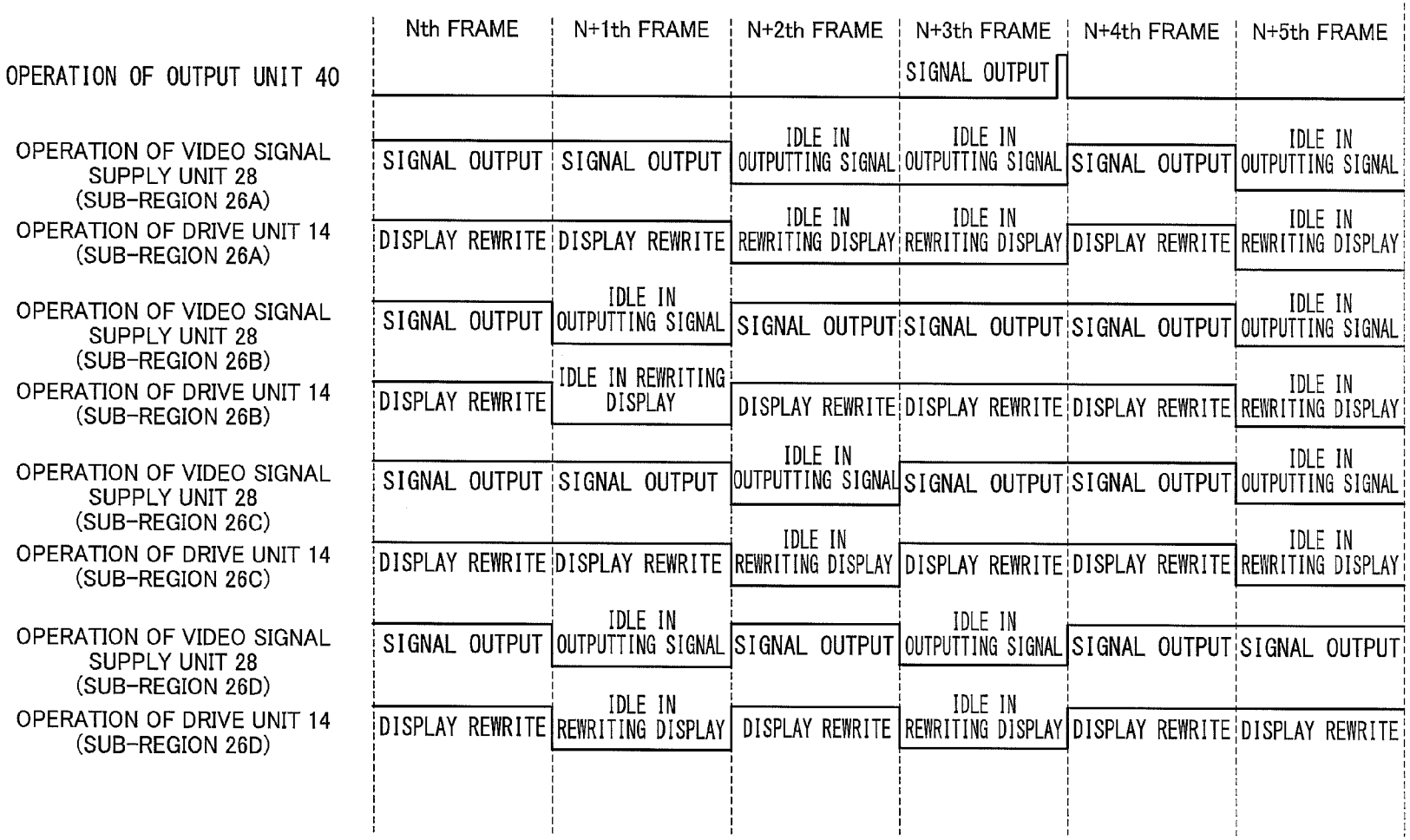
FIG. 5B is a timing chart illustrating how the output unit, video signal supply unit and drive unit operate when the video displayed on the display region changes as illustrated in FIG. 5A.

For example, as shown in FIGS. 5A and 5B, when the display on the specified sub-region (i.e. sub-region 26A) is to be refreshed, the displays on all the sub-regions 26A, 26B, 26C and 26D may be refreshed. In this implementation, the other sub-regions 26B, 26C and 26D have their displays refreshed within a predetermined number of frames (i.e. 2 frames in the present embodiment). Thus, it is less likely that there is a sub-region on which the drive unit 14 has not rewritten the display for a predetermined number of frames. As a result, the liquid crystal panel 12 is less likely to deteriorate.

Second Embodiment

Figure 6A:
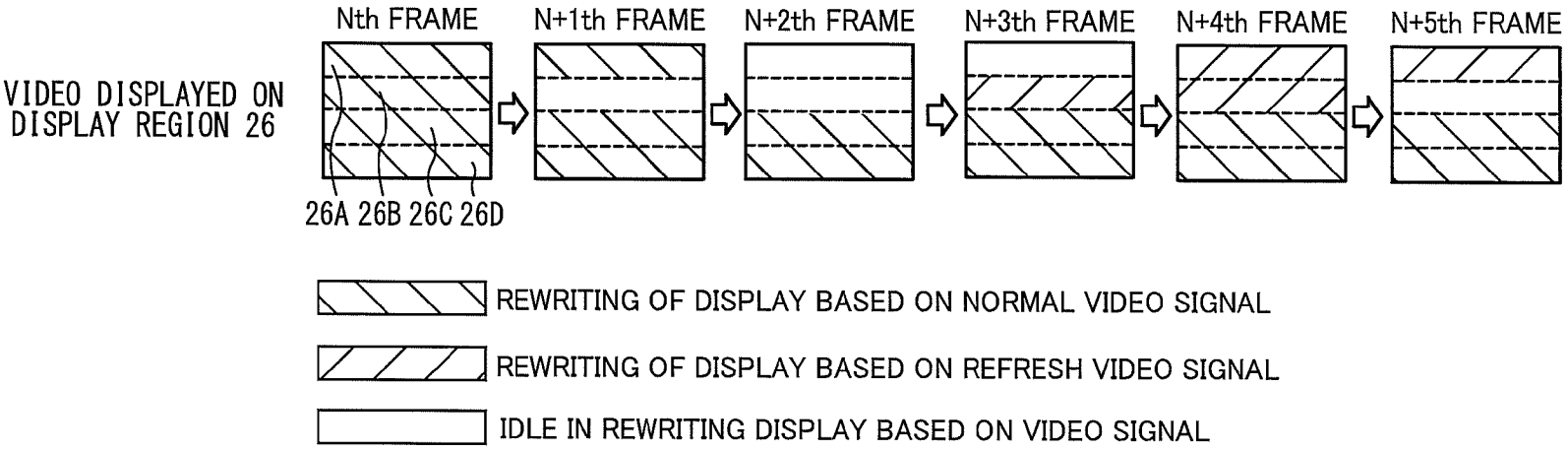
FIG. 6A illustrates how the video displayed on the display region changes from one frame to another in a second embodiment.
Figure 6B:
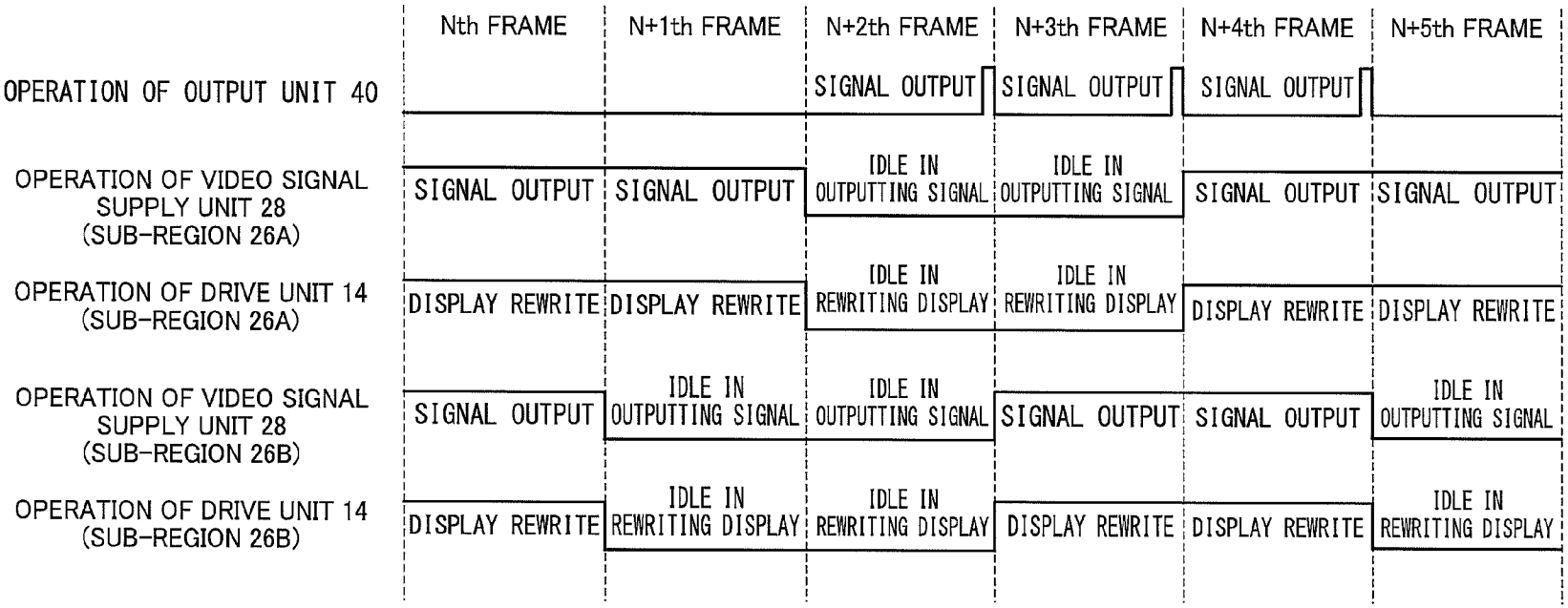
FIG. 6B is a timing chart illustrating how the output unit, video signal supply unit and drive unit operate when the video displayed on the display region changes as illustrated in FIG. 6A.

For example, the output unit 40 may provide an interrupt signal in each of a plurality of consecutive frames. More specifically, as shown in FIGS. 6A and 6B, the output signal 40 may provide an interrupt signal at the end of the N+3th frame and at the end of the N+4th frame. If a refresh video signal is received each time an interrupt signal is provided, the capacitance of the storage capacitor 20 can be brought close to the level required to display the intended gray scale level. This prevents an afterimage from being produced on the display region 26.

Example Application of Second Embodiment

Figure 7A:
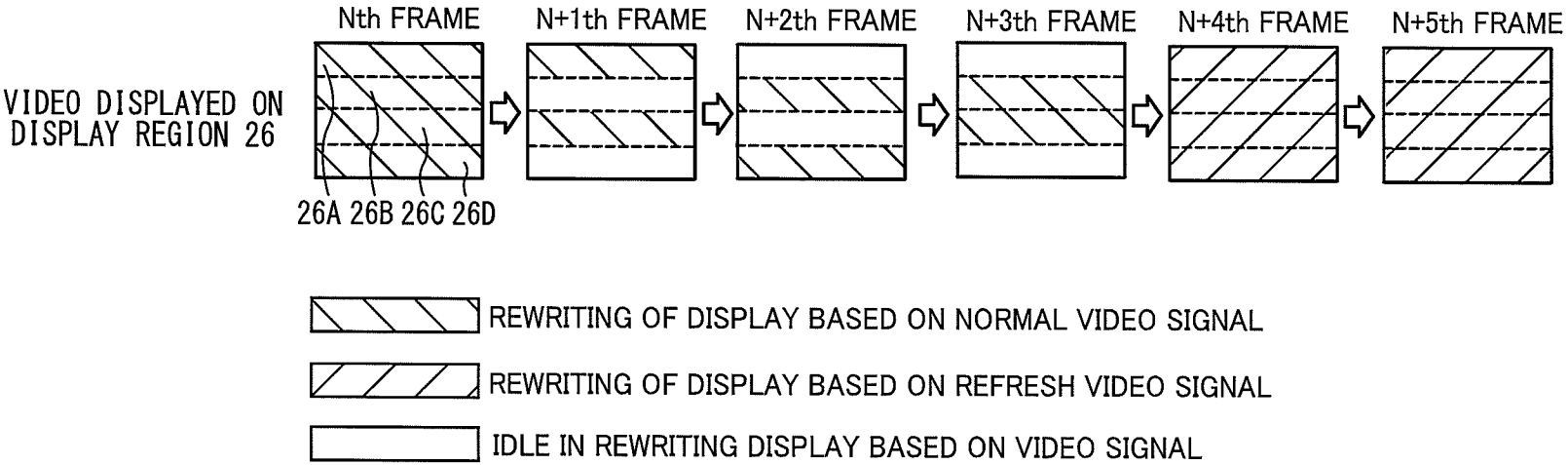
FIG. 7A illustrates how the video displayed on the display region changes from one frame to another in an example application of the second embodiment.

For example, as shown in FIGS. 7A and 7B, when the display on the specified sub-region (i.e. sub-region 26A) is to be refreshed in the N+4th frame, the displays on all the sub-regions 26A, 26B, 26C and 26D may be refreshed in the N+4th and N+5th frames.

Third Embodiment

Figure 8A:
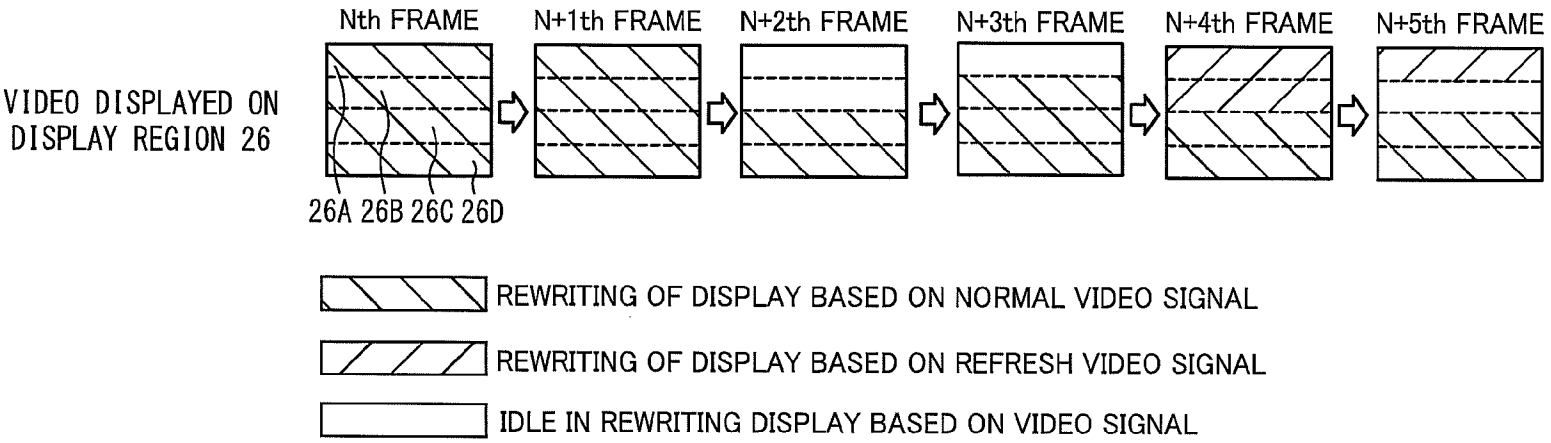
FIG. 8A illustrates how the video displayed on the display region changes from one frame to another in a third embodiment.
Figure 8B:
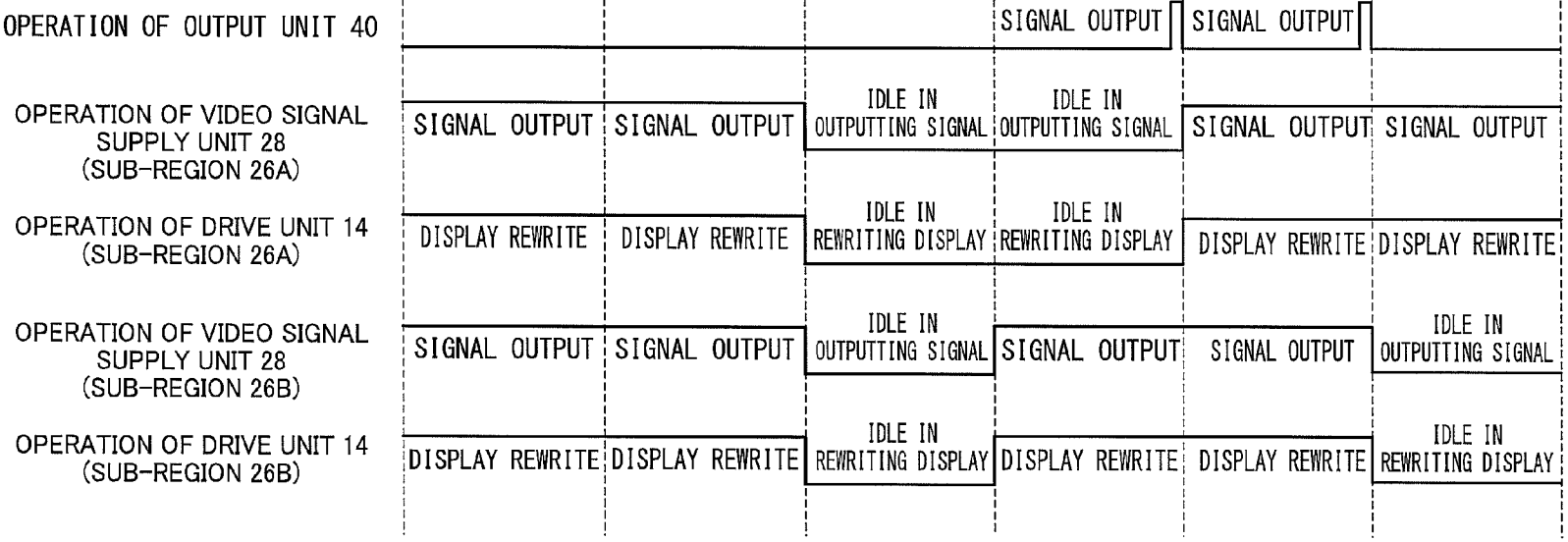
FIG. 8B is a timing chart illustrating how the output unit, video signal supply unit and drive unit operate when the video displayed on the display region changes as illustrated in FIG. 8A.

For example, as shown in FIGS. 8A and 8B, when a display is refreshed within a predetermined number of frames (i.e. 2 frames in the present embodiment) (which applies to the sub-region 26B in the N+3th frame in the present embodiment), the video signal provided at this moment may be provided in the next frame once again as a refresh video signal. In this implementation, the capacitance of the storage capacitor 20 can be brought close to the level required to display the intended gray scale level. This prevents an afterimage from being produced on the display region 26.

Example Application of Third Embodiment

Figure 9A:
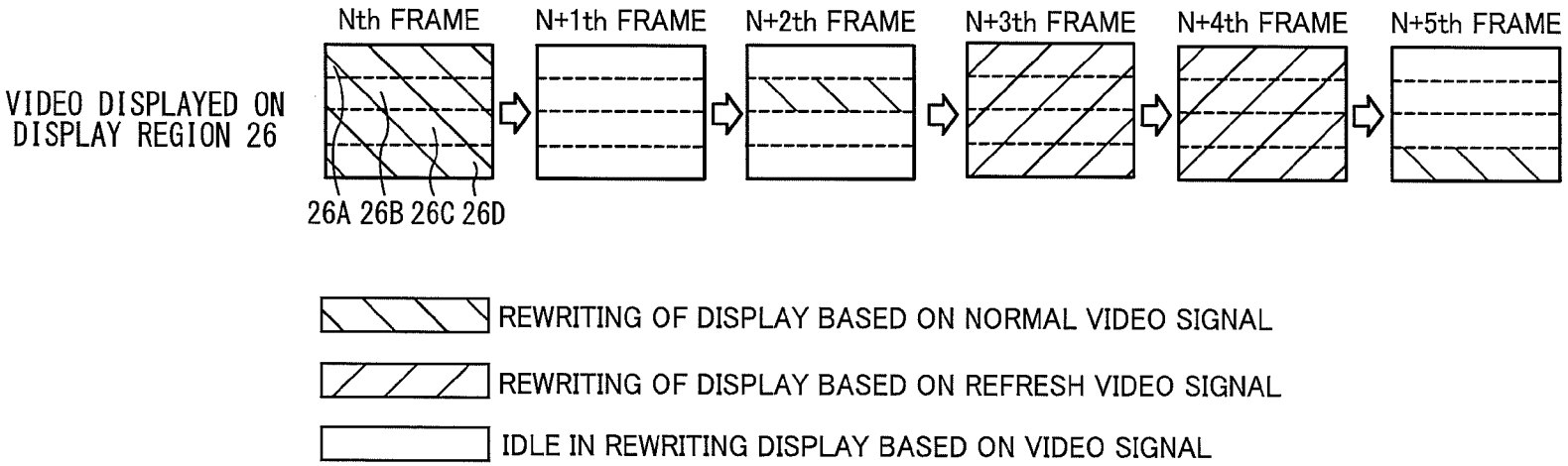
FIG. 9A illustrates how the video displayed on the display region changes from one frame to another in an example application of the third embodiment.
Figure 9B:
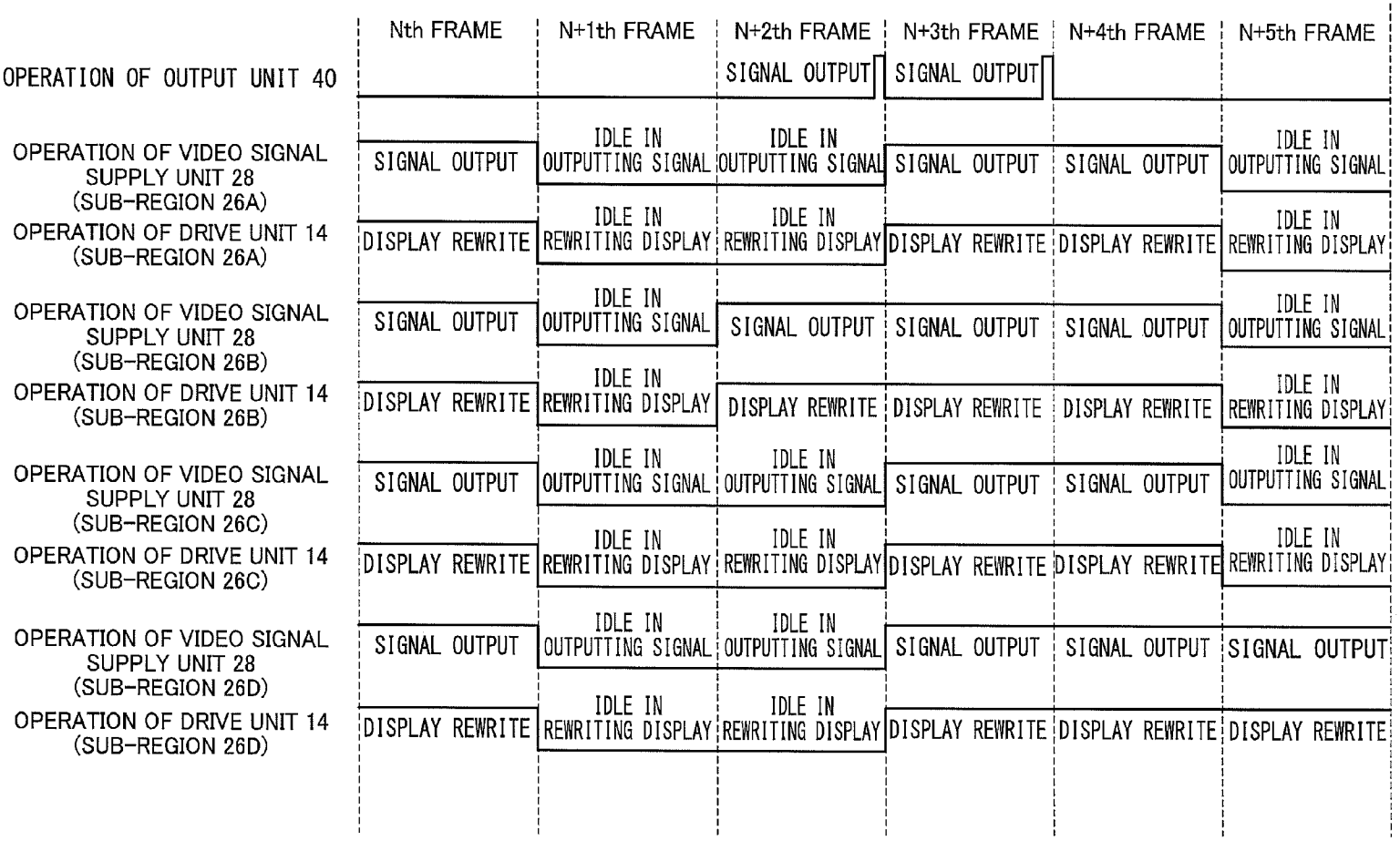
FIG. 9B is a timing chart illustrating how the output unit, video signal supply unit and drive unit operate when the video displayed on the display region changes as illustrated in FIG. 9A.

For example, as shown in FIGS. 9A and 9B, when the display on the specified sub-region (i.e. sub-region 26B) is to be refreshed, the displays on all the sub-regions 26A, 26B, 26C and 26D may be refreshed.

Fourth Embodiment

Figure 10A:
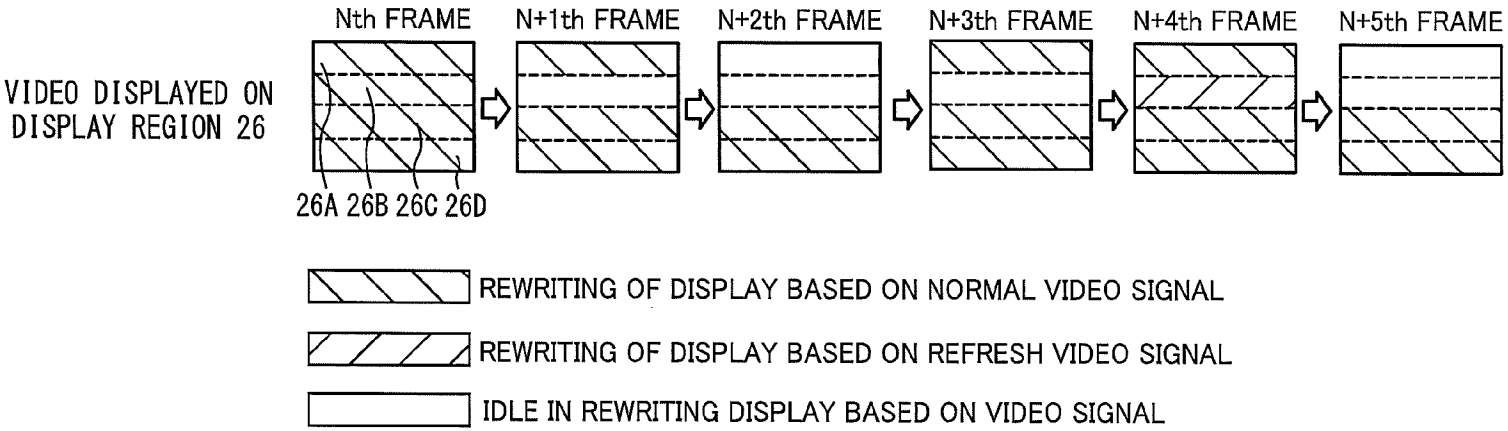
FIG. 10A illustrates how the video displayed on the display region changes from one frame to another in a fourth embodiment.
Figure 10B:
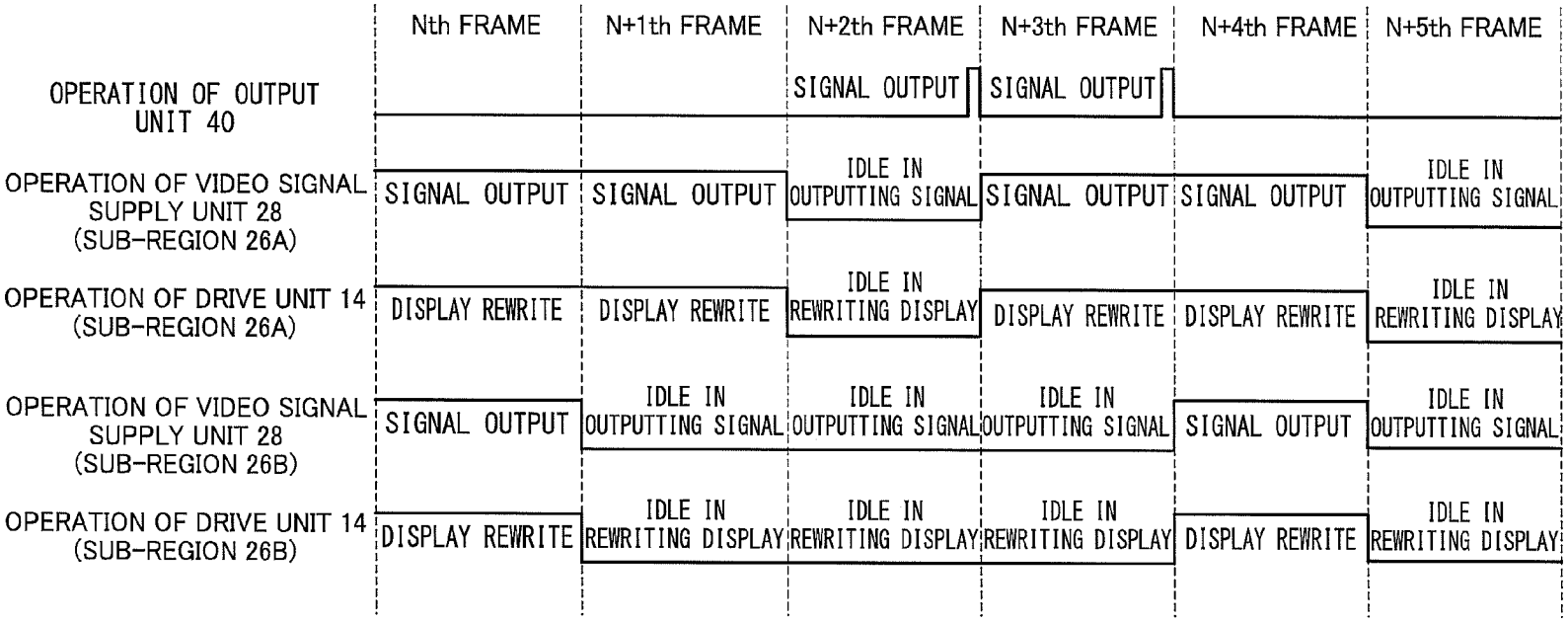
FIG. 10B is a timing chart illustrating how the output unit, video signal supply unit and drive unit operate when the video displayed on the display region changes as illustrated in FIG. 10A.

For example, as shown in FIGS. 10A and 10B, if the device receives no refresh video signal even after the output unit 40 provided an interrupt signal, it may provide an interrupt signal in the next frame once again.

Example Application of Fourth Embodiment

Figure 11A:
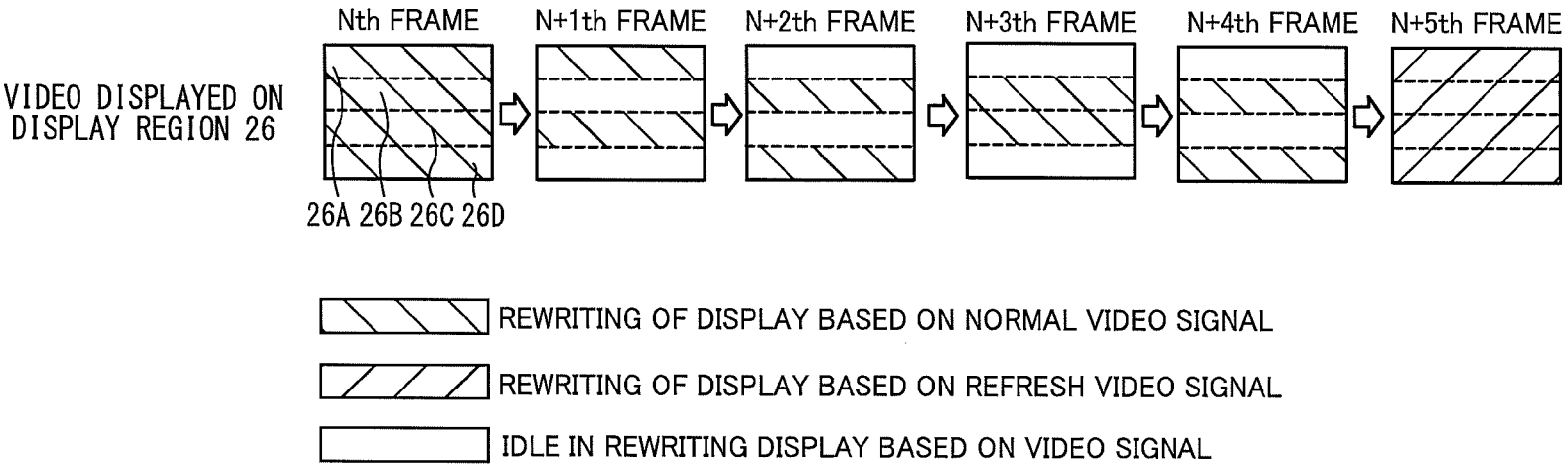
FIG. 11A illustrates how the video displayed on the display region changes from one frame to another in an example application of the fourth embodiment.
Figure 11B:
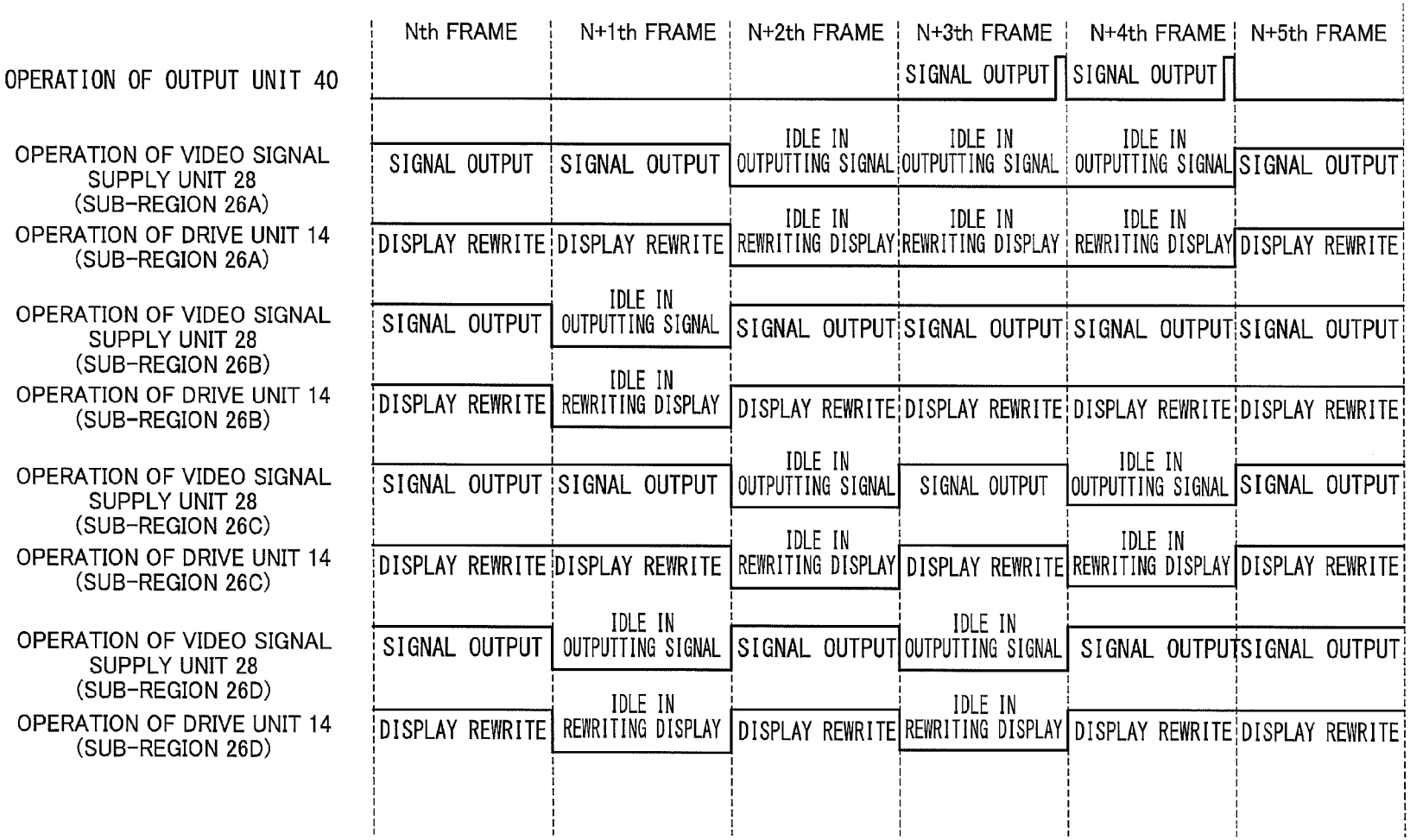
FIG. 11B is a timing chart illustrating how the output unit, video signal supply unit and drive unit operate when the video displayed on the display region changes as illustrated in FIG. 11A.

For example, as shown in FIGS. 11A and 11B, when the display on the specified sub-region (i.e. sub-region 26A) is to be refreshed, the displays on all the sub-regions 26A, 26B, 26C and 26D may be refreshed.

Fifth Embodiment

Figure 12A:
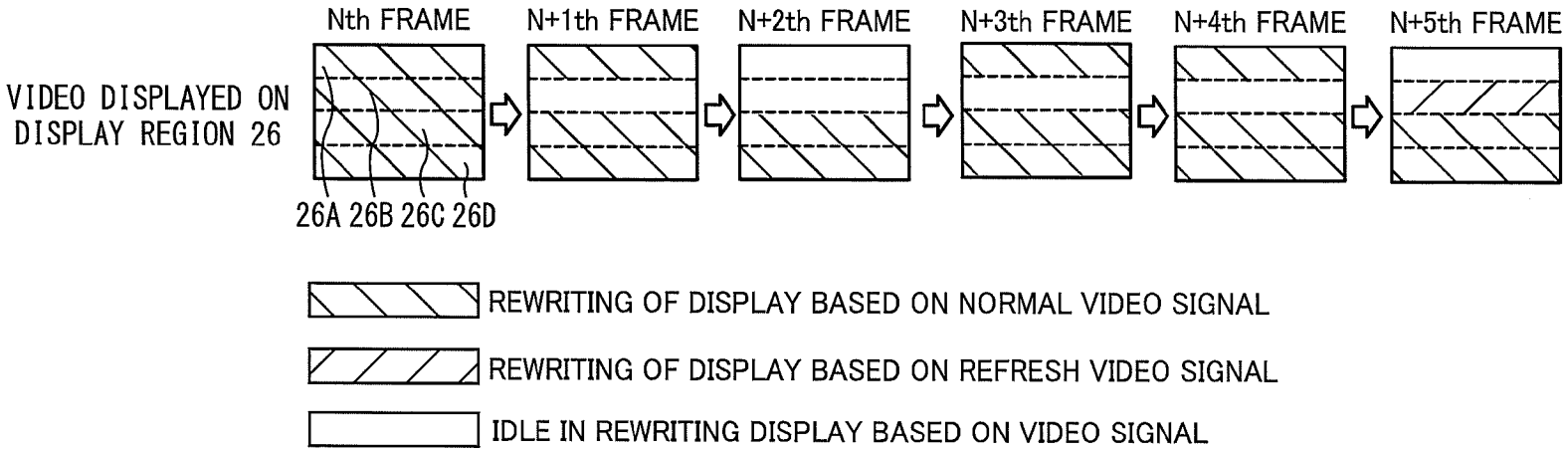
FIG. 12A illustrates how the video displayed on the display region changes from one frame to another in a fifth embodiment.
Figure 12B:
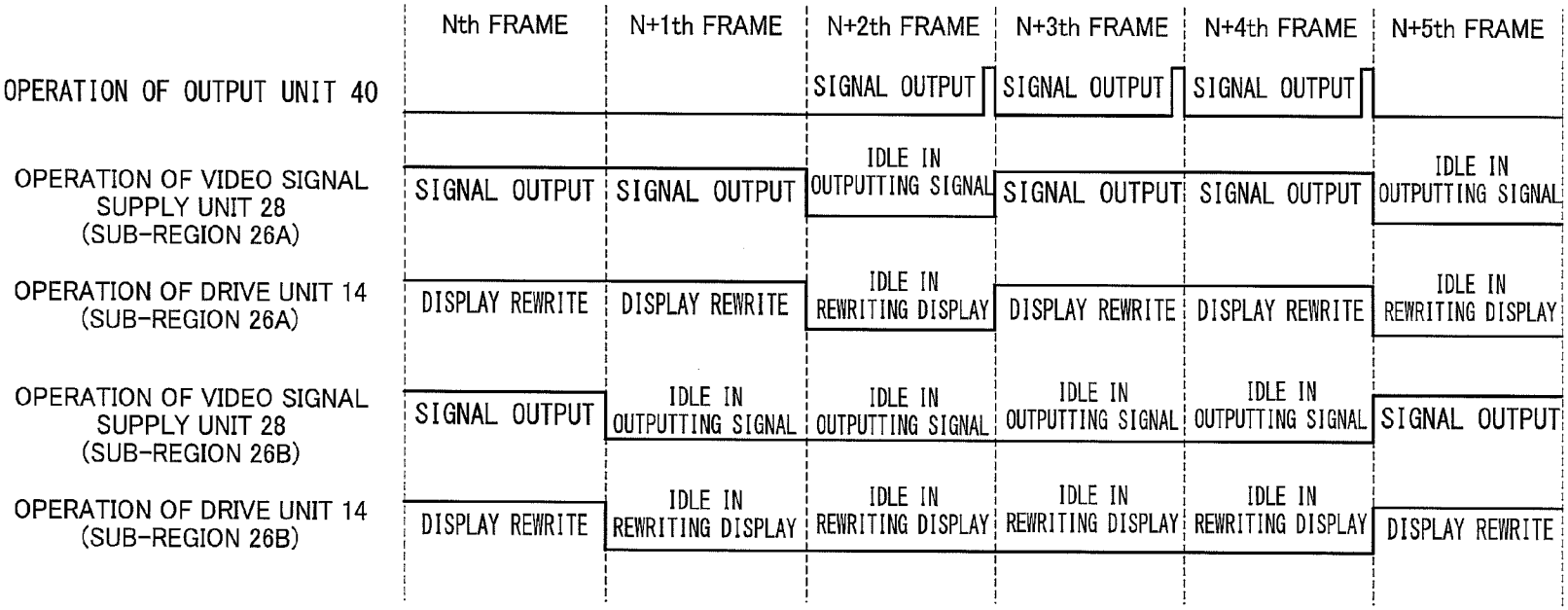
FIG. 12B is a timing chart illustrating how the output unit, video signal supply unit and drive unit operate when the video displayed on the display region changes as illustrated in FIG. 12A.

For example, as shown in FIGS. 12A and 12B, if the device receives no refresh video signal even after the output unit 40 provided an interrupt signal, it may provide an interrupt signal repeatedly until the device receives a refresh video signal. This prevents deterioration of the liquid crystal panel 12 more reliably than in implementations where an interrupt signal is provided only once.

Example Application of Fifth Embodiment

Figure 13A:
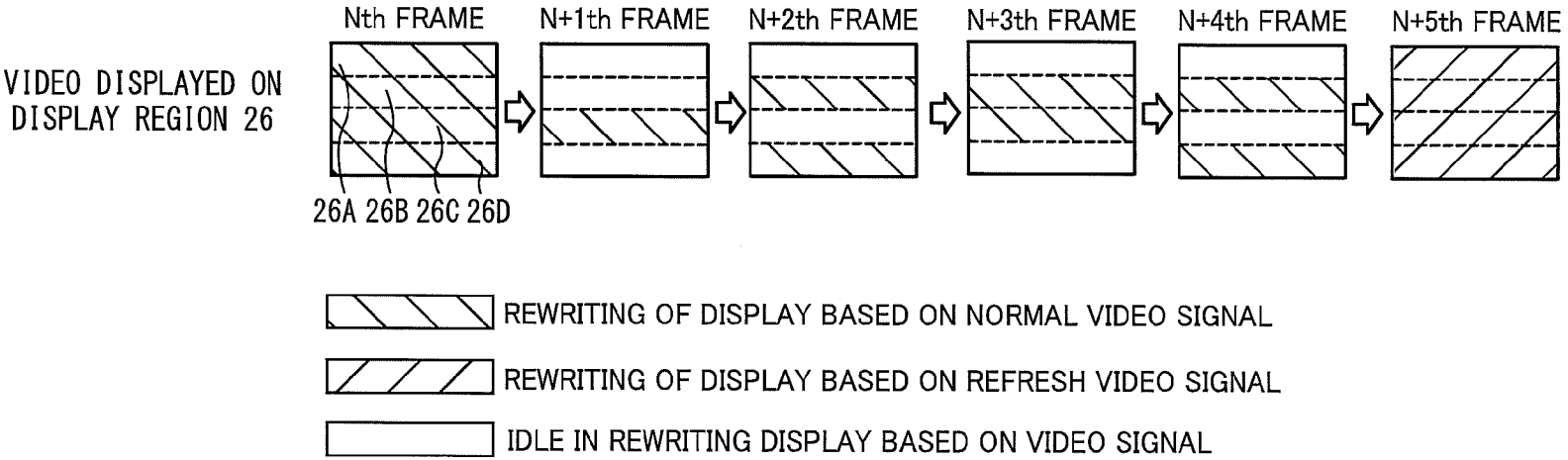
FIG. 13A illustrates how the video displayed on the display region changes from one frame to another in an example application of the fifth embodiment.
Figure 13B:
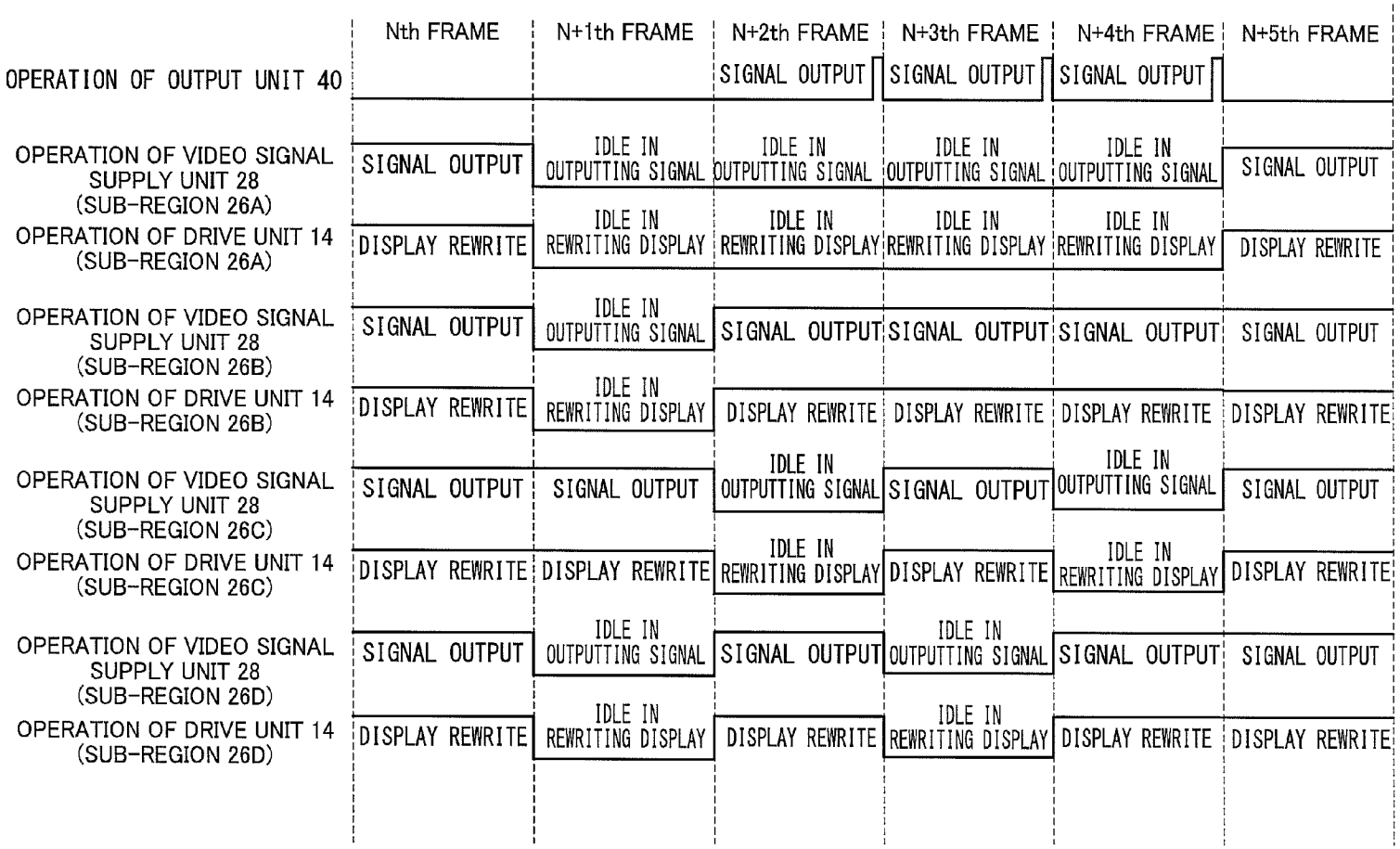
FIG. 13B is a timing chart illustrating how the output unit, video signal supply unit and drive unit operate when the video displayed on the display region changes as illustrated in FIG. 13A.

For example, as shown in FIGS. 13A and 13B, when the display on the specified sub-region (i.e. sub-region 26A) is to be refreshed, the displays on all the sub-regions 26A, 26B, 26C and 26D may be refreshed.

Sixth Embodiment

Figure 14A:
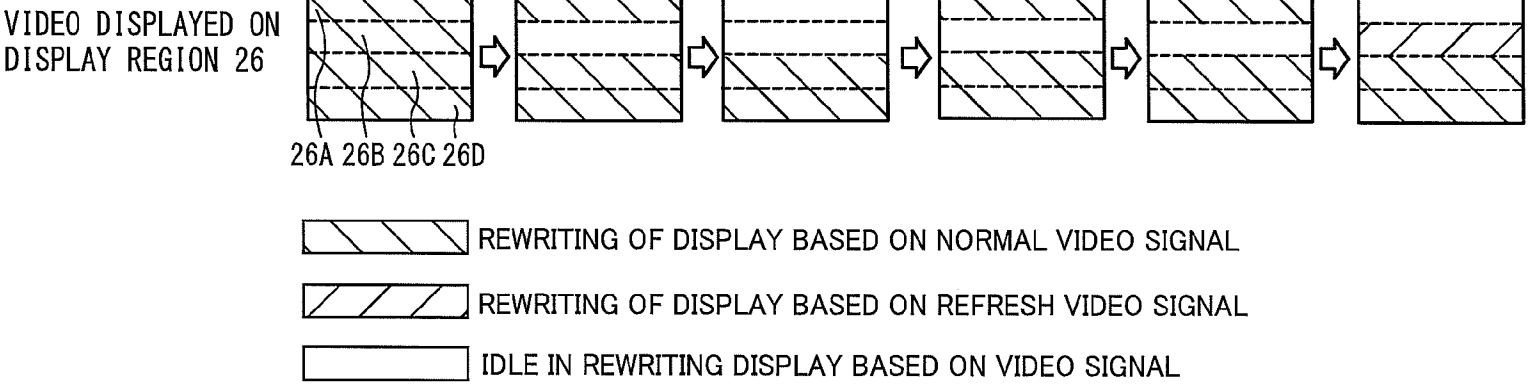
FIG. 14A illustrates how the video displayed on the display region changes from one frame to another in a sixth embodiment.
Figure 14B:
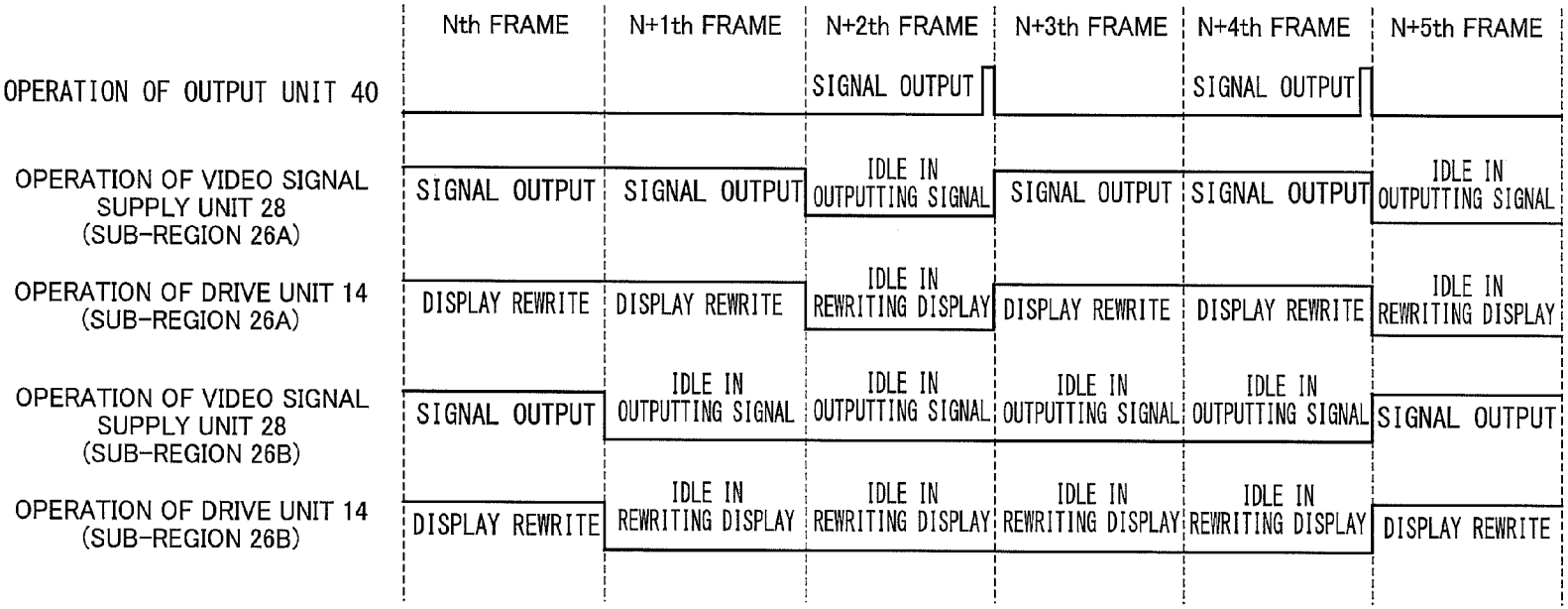
FIG. 14B is a timing chart illustrating how the output unit, video signal supply unit and drive unit operate when the video displayed on the display region changes as illustrated in FIG. 14A.

For example, as shown in FIGS. 14A and 14B, if the device receives no refresh video signal in a predetermined number of frames (i.e. 2 frames in the present embodiment) after the output unit 40 provided an interrupt signal, it may provide an interrupt signal once again.

Example Application of Sixth Embodiment

Figure 15A:
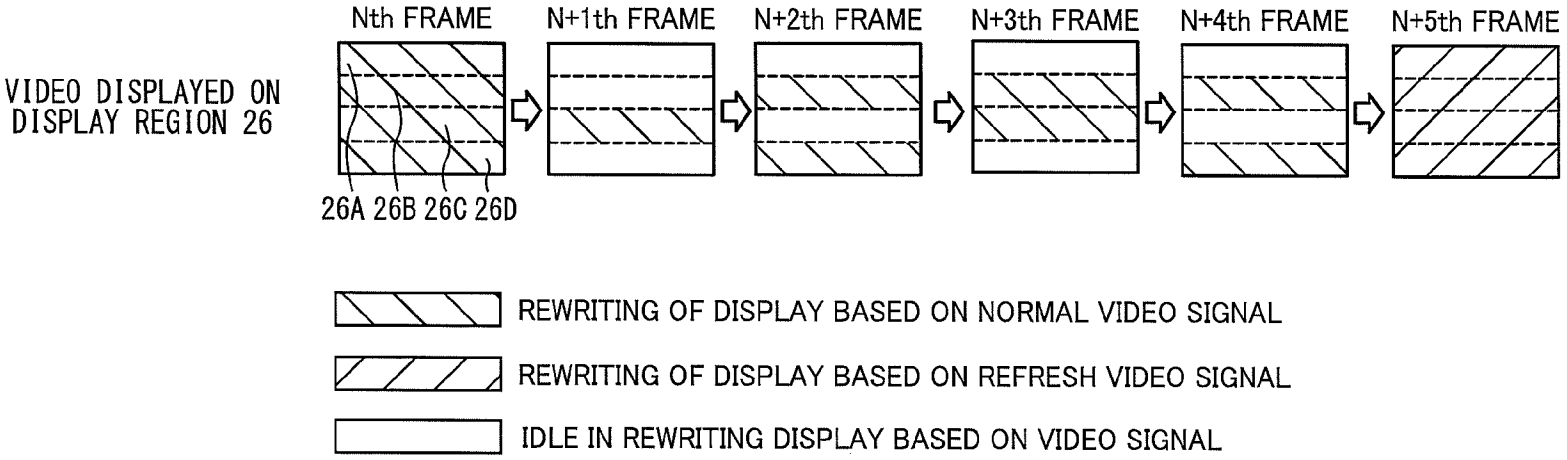
FIG. 15A illustrates how the video displayed on the display region changes from one frame to another in an example application of the sixth embodiment.

For example, as shown in FIGS. 15A and 15B, when the display on the specified sub-region (i.e. sub-region 26A) is to be refreshed, the displays on all the sub-regions 26A, 26B, 26C and 26D may be refreshed.

Seventh Embodiment

Figure 16A:
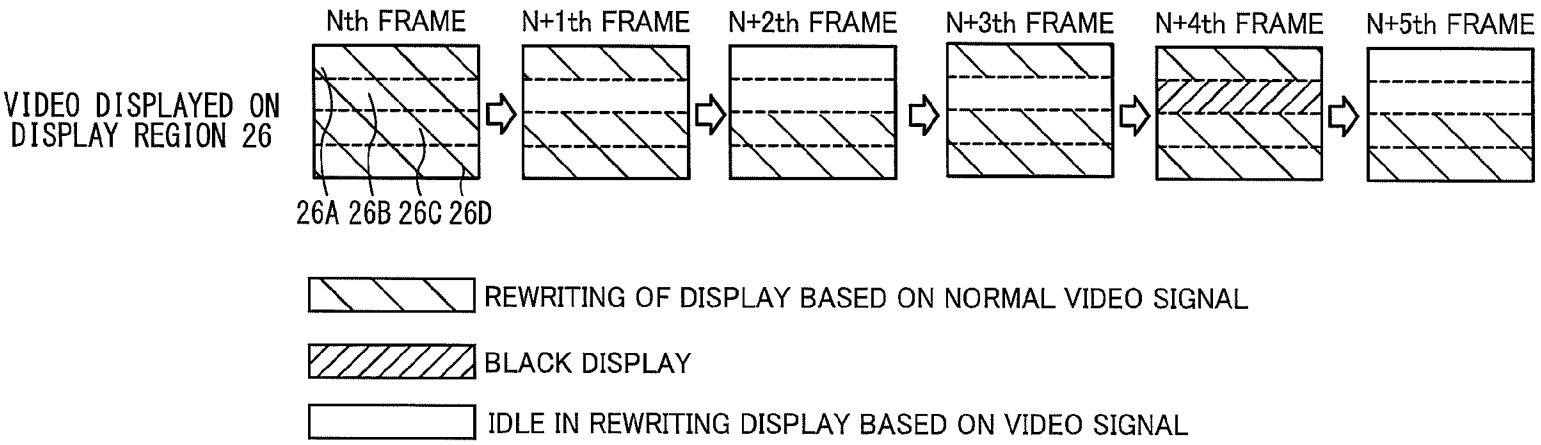
FIG. 16A illustrates how the video displayed on the display region changes from one frame to another in a seventh embodiment.
Figure 16B:
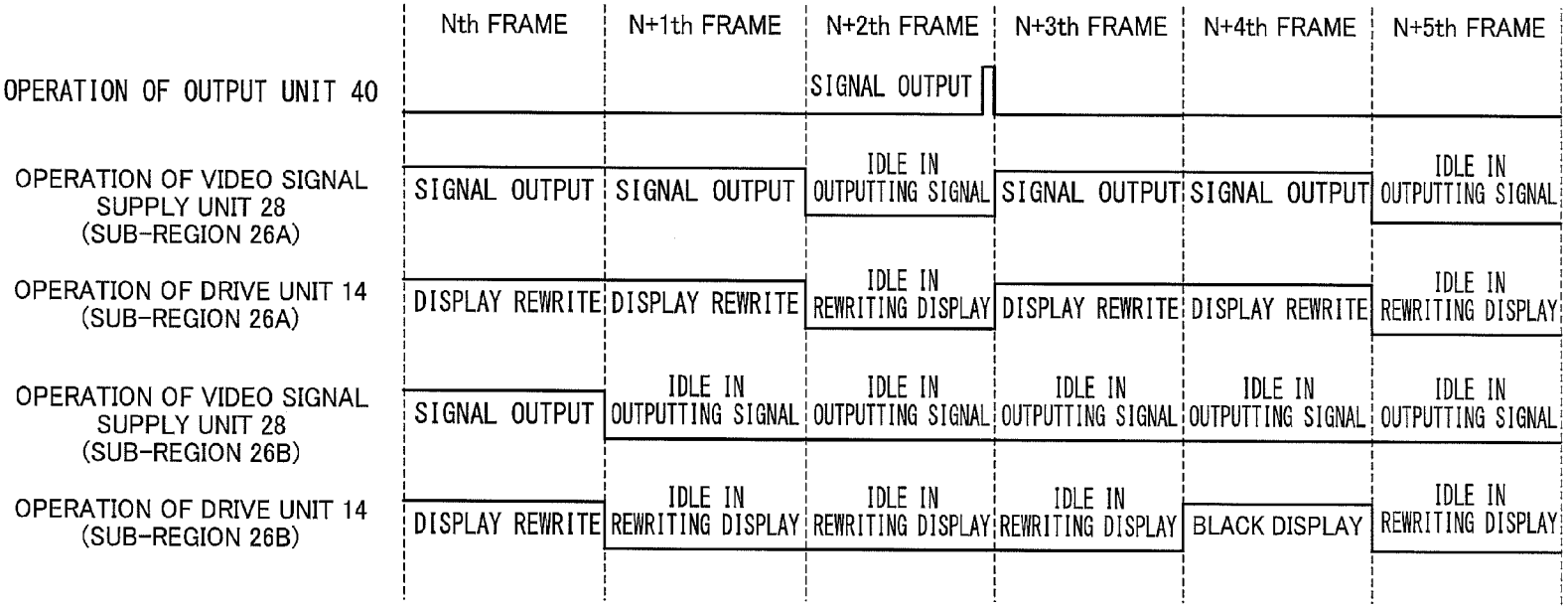
FIG. 16B is a timing chart illustrating how the output unit, video signal supply unit and drive unit operate when the video displayed on the display region changes as illustrated in FIG. 16A.

For example, as shown in FIGS. 16A and 16B, if the device receives no refresh video signal even after the output unit 40 provided an interrupt signal, the device may display black on the specified sub-region (i.e. sub-region 26B in the present embodiment). If the liquid crystal panel 12 is a normally-black liquid crystal panel, a black display is achieved without applying a voltage to the liquid crystal. This prevents the liquid crystal panel 12 from deteriorating.

The video data signals for such a black display may be stored in the ROM of the drive unit 14, for example. If the liquid crystal panel 12 is a normally-white liquid crystal panel, the device may display white, instead of black, on the specified sub-region.

Example Application of Seventh Embodiment

Figure 17A:
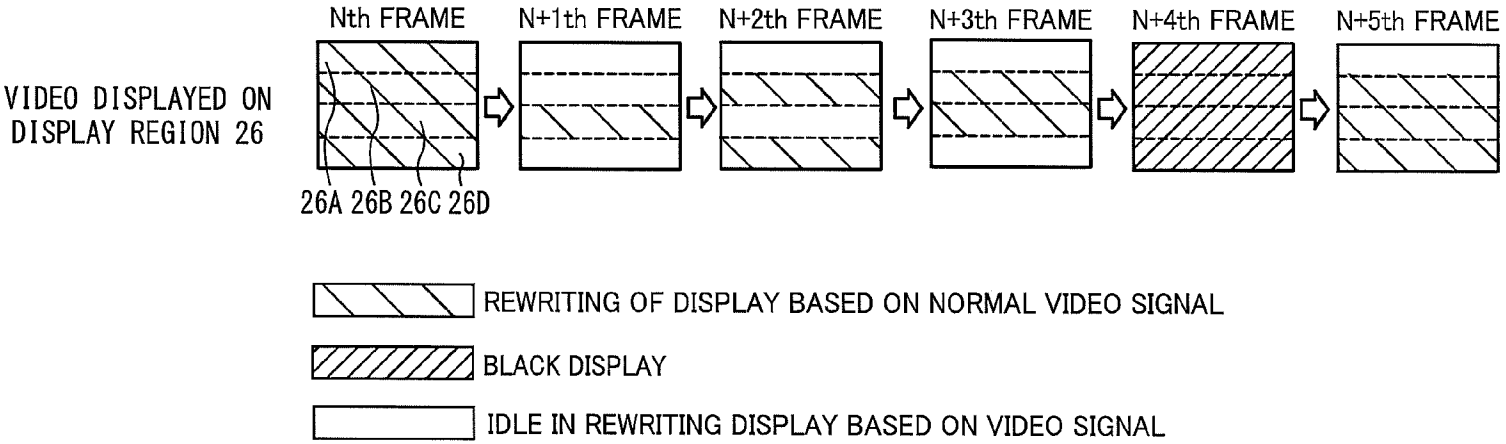
FIG. 17A illustrates how the video displayed on the display region changes from one frame to another in an example application of the seventh embodiment.

For example, as shown in FIGS. 17A and 17B, the device may display black on not just the specified sub-region (i.e. sub-region 26A), but on all the sub-regions 26A, 26B, 26C and 26D. In the implementation shown in FIGS. 17A and 17B, in the N+4th frame in which the device displays black on all the sub-regions 26A, 26B, 26C and 26D, video signals for rewriting the displays on the sub-regions 26B and 26D (i.e. second and fourth normal video signals) are received; however, these video signals are not used.

Eighth Embodiment

Figure 18A:
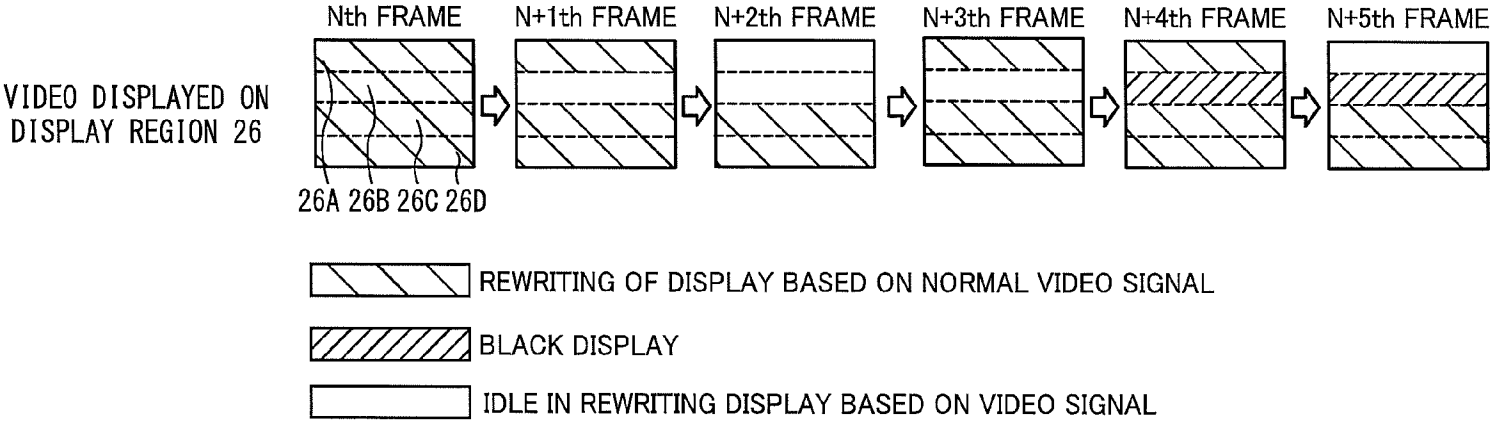
FIG. 18A illustrates how the video displayed on the display region changes from one frame to another in an eighth embodiment.
Figure 18B:
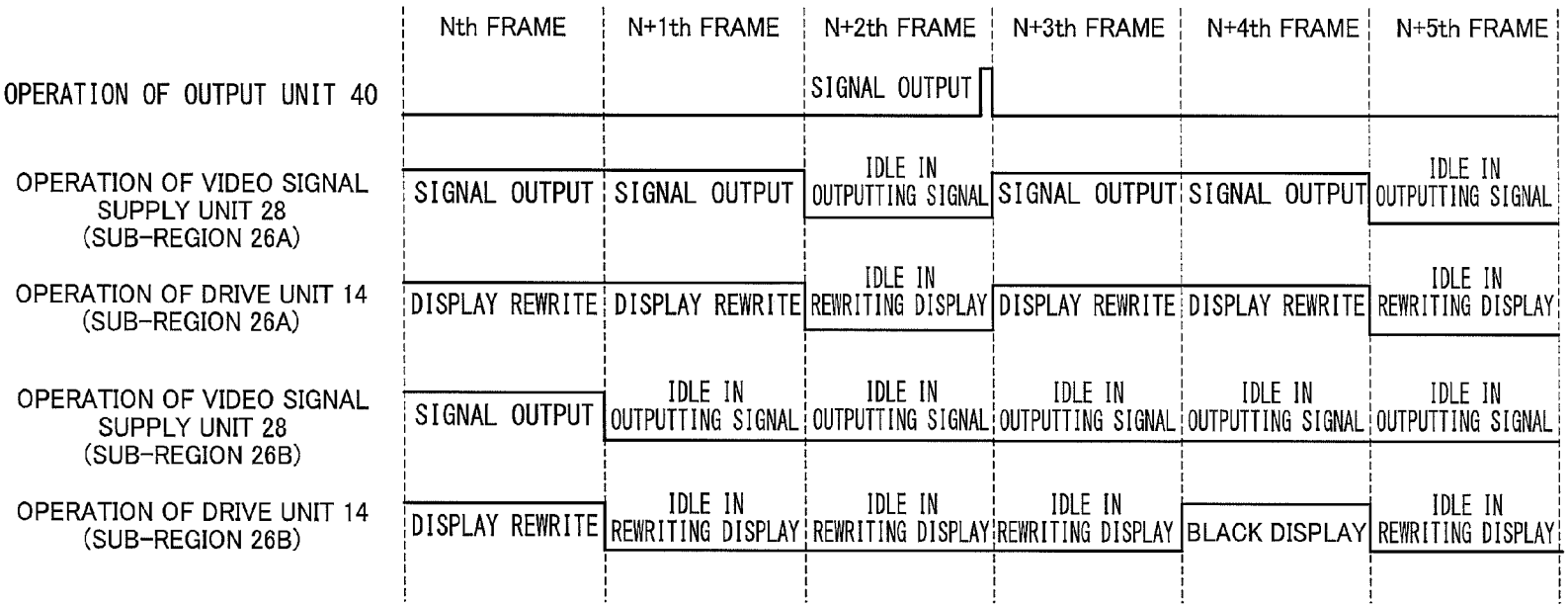
FIG. 18B is a timing chart illustrating how the output unit, video signal supply unit and drive unit operate when the video displayed on the display region changes as illustrated in FIG. 18A.

For example, as shown in FIGS. 18A and 18B, if the device receives no refresh video signal even after the output unit 40 provided an interrupt signal, the device may display black on the specified sub-region (i.e. sub-region 26B in the present embodiment), and maintain such a black display for a predetermined number of frames (e.g. 2 frames in the present embodiment).

Example Application of Eighth Embodiment

Figure 19A:
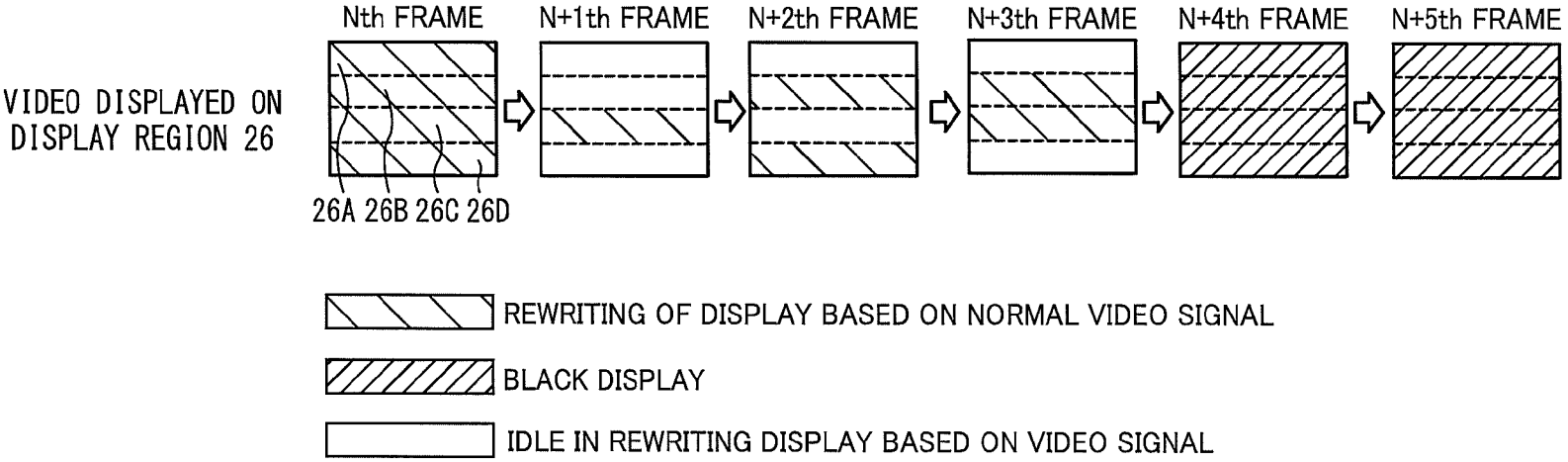
FIG. 19A illustrates how the video displayed on the display region changes from one frame to another in an example application of the eighth embodiment.

For example, as shown in FIGS. 19A and 19B, the device may display black on not just the specified sub-region (i.e. sub-region 26A), but on all the sub-regions 26A, 26B, 26C and 26D. In the implementation shown in FIGS. 19A and 19B, in the N+4th frame in which the device displays black on all the sub-regions 26A, 26B, 26C and 26D, video signals for rewriting the displays on the sub-regions 26B and 26D (i.e. second and fourth normal video signals) are received; however, these video signals are not used. Further, in the N+5th frame in which the device displays black on all the sub-regions 26A, 26B, 26C and 26D, video signals for rewriting the displays on the sub-regions 26B, 26C and 26D (i.e. second, third and fourth normal video signals) are received; however, these video signals are not used.

Ninth Embodiment

Figure 20A:
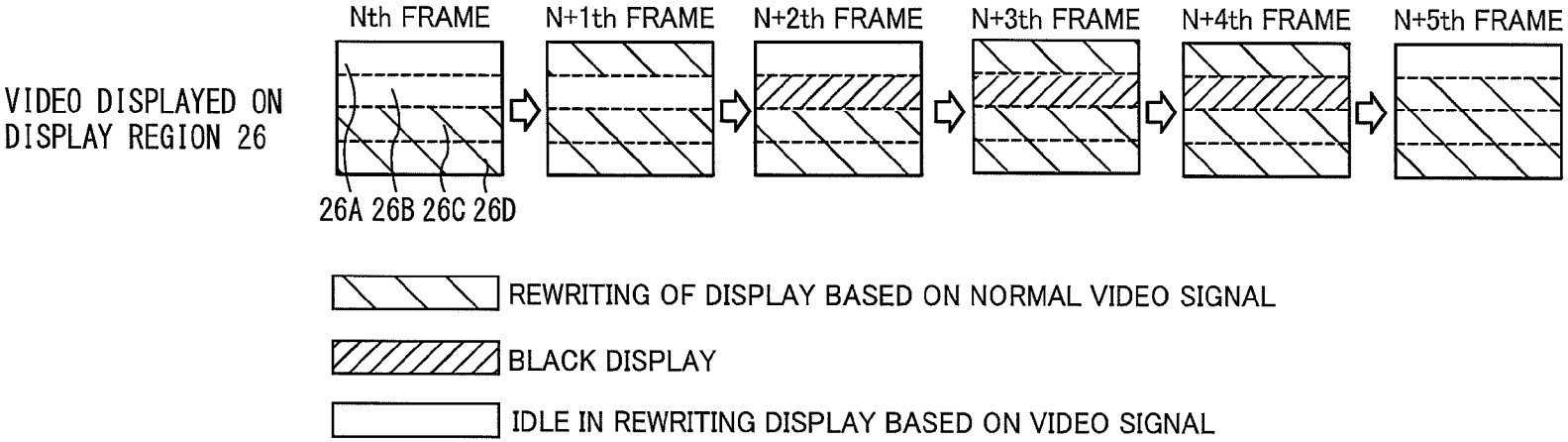
FIG. 20A illustrates how the video displayed on the display region changes from one frame to another in a ninth embodiment.
Figure 20B:
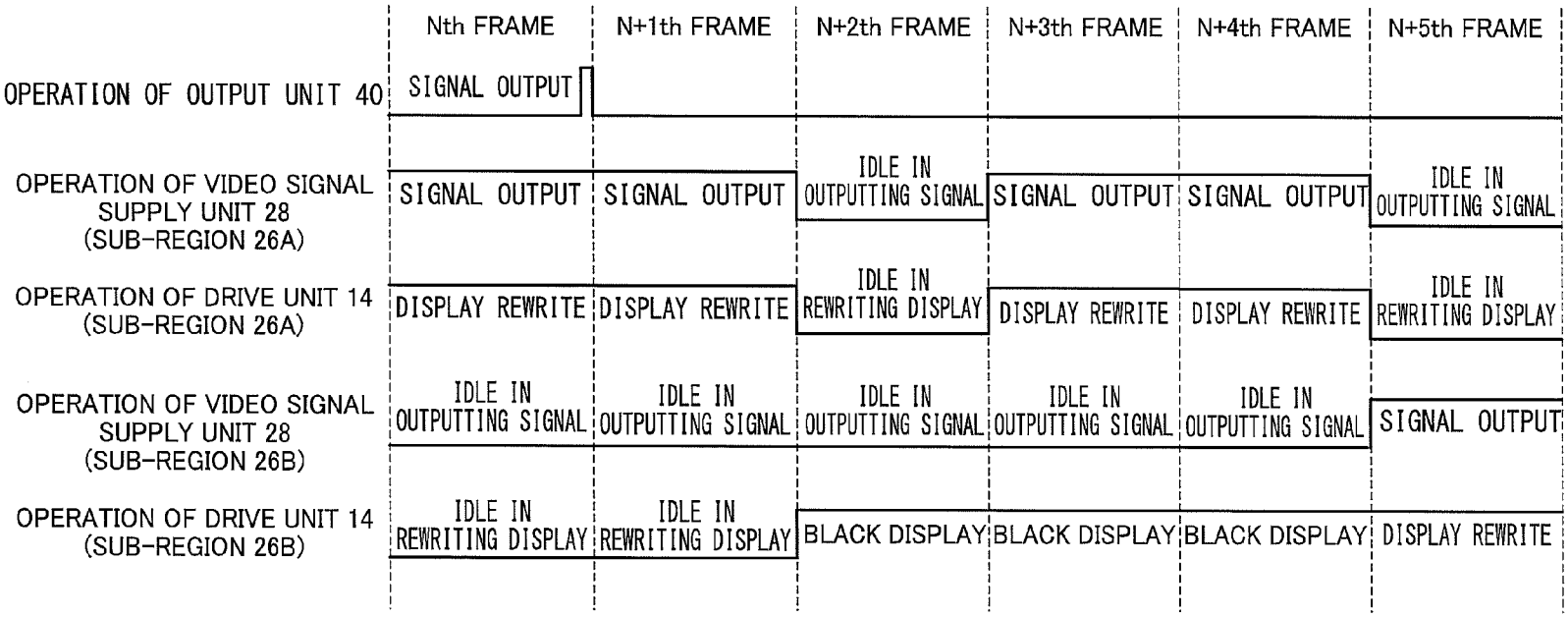
FIG. 20B is a timing chart illustrating how the output unit, video signal supply unit and drive unit operate when the video displayed on the display region changes as illustrated in FIG. 20A.

For example, as shown in FIGS. 20A and 20B, if the device receives no refresh video signal even after the output unit 40 provided an interrupt signal, the device may display black on the specified sub-region (i.e. sub-region 26B in the present embodiment), and maintain such a black display until it receives a video signal for rewriting the display on the specified sub-region (i.e. normal video signal or refresh video signal).

Example Application of Ninth Embodiment

Figure 21A:
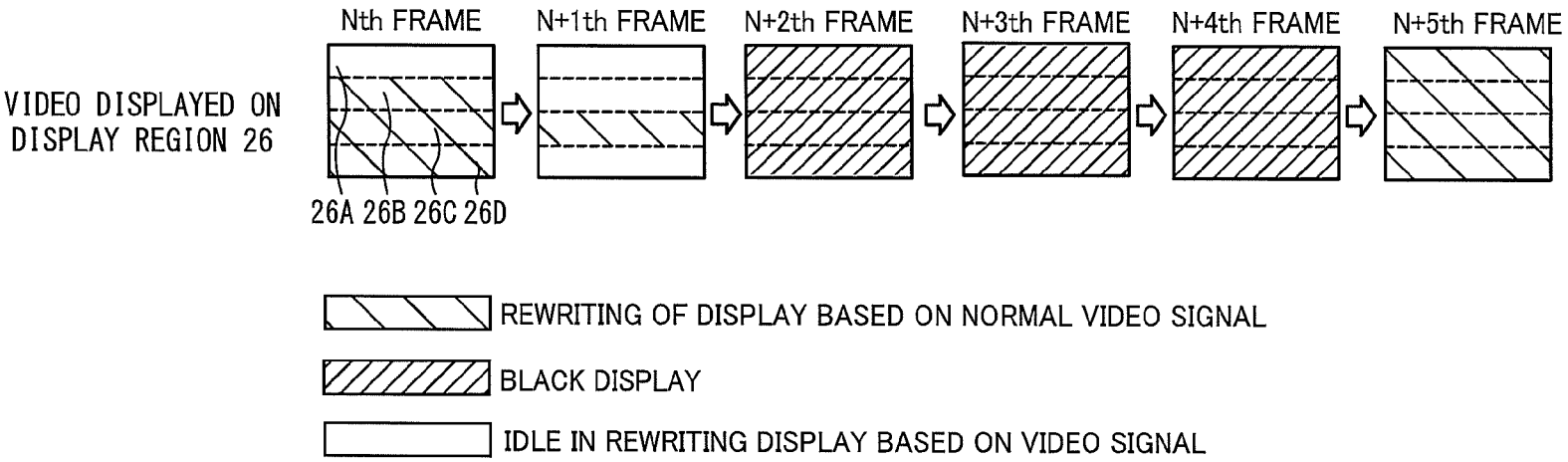
FIG. 21A illustrates how the video displayed on the display region changes from one frame to another in an example application of the ninth embodiment.

For example, as shown in FIGS. 21A and 21B, the device unit may display black on not just the specified sub-region (i.e. sub-region 26A), but on all the sub-regions 26A, 26B, 26C and 26D. In the implementation shown in FIGS. 21A and 21B, in the N+2th and N+4th frames in which the device displays black on all the sub-regions 26A, 26B, 26C and 26D, video signals for rewriting the displays on the sub-regions 26B and 26D (i.e. second and fourth normal video signals) are received; however, these video signals are not used. Further, in the N+3th frame in which the device displays black on all the sub-regions 26A, 26B, 26C and 26D, video signals for rewriting the displays on the sub-regions 26B and 26C (i.e. second and third normal video signals) are received; however, these video signals are not used.

Tenth Embodiment

For example, if the device receives no refresh video signal even after the output unit 40 provided an interrupt signal, the device may display black on the specified sub-region, and maintain such a black display until the liquid crystal display device 10 is powered off. In such implementations, the device may display black on not just the specified sub-region, but on all the sub-regions 26A, 26B, 26C and 26D.

Eleventh Embodiment

Figure 22A:
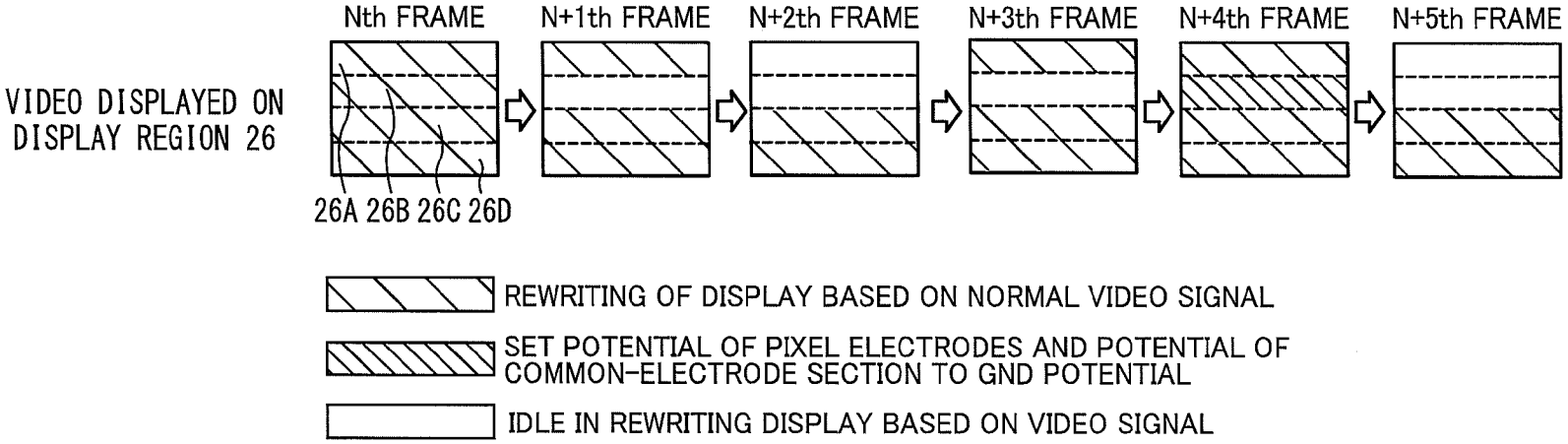
FIG. 22A illustrates how the video displayed on the display region changes from one frame to another in an eleventh embodiment.
Figure 22B:
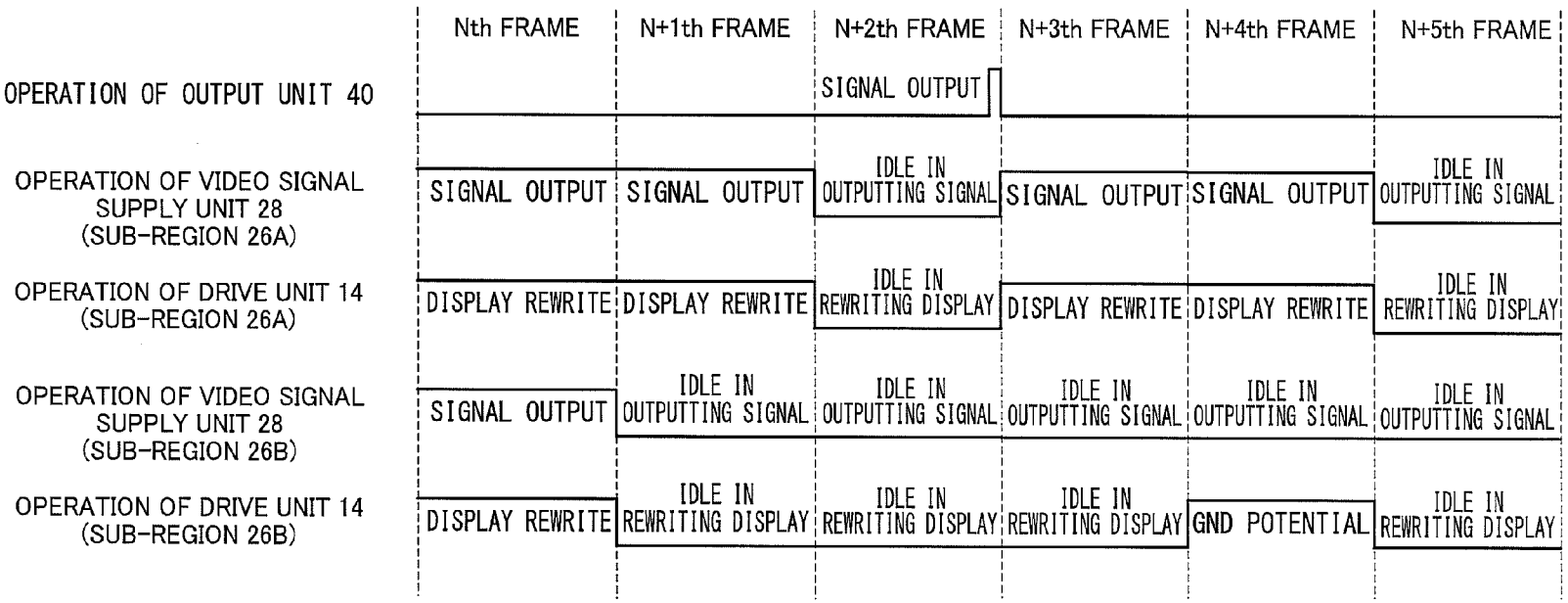
FIG. 22B is a timing chart illustrating how the output unit, video signal supply unit and drive unit operate when the video displayed on the display region changes as illustrated in FIG. 22A.

For example, as shown in FIGS. 22A and 22B, if the device receives no refresh video signal even after the output unit 40 provided an interrupt signal, it may change the potential of the pixel electrodes 22 of the pixel units 16 forming the specified sub-region (i.e. sub-region 26B in the present embodiment) and the potential of the common-electrode section corresponding to the specified sub-region to the GND potential. The potential of the pixel electrodes 22 and the potential of the common-electrode section may be set to other common potentials than the GND potential.

Example Application of Eleventh Embodiment

Figure 23A:
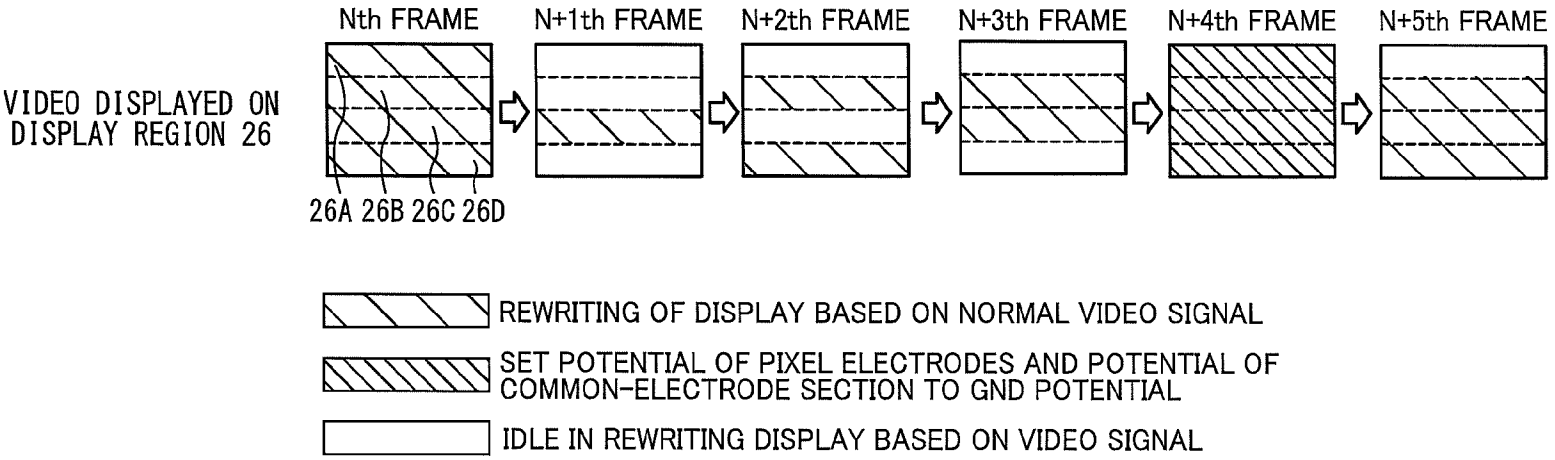
FIG. 23A illustrates how the video displayed on the display region changes from one frame to another in an example application of the eleventh embodiment.

For example, as shown in FIGS. 23A and 23B, not just the potential of the pixel electrodes 22 and the potential of the common-electrode section in the specified sub-region (i.e. sub-region 26A), but those in all the sub-regions 26A, 26B, 26C and 26D may be changed to the GND potential. In the implementation shown in FIGS. 23A and 23B, in the N+4th frame in which the potential of the pixel electrodes 22 and the potential of the common-electrode sections in all the sub-regions 26A, 26B, 26C and 26D are changed to the GND potential, video signals for rewriting the displays on the sub-regions 26B and 26D (i.e. second and fourth normal video signals) are received; however, these video signals are not used.

While embodiments of the present invention have been described in detail, these are merely examples and the present invention is not limited to these embodiments in any way.

Figure 24:
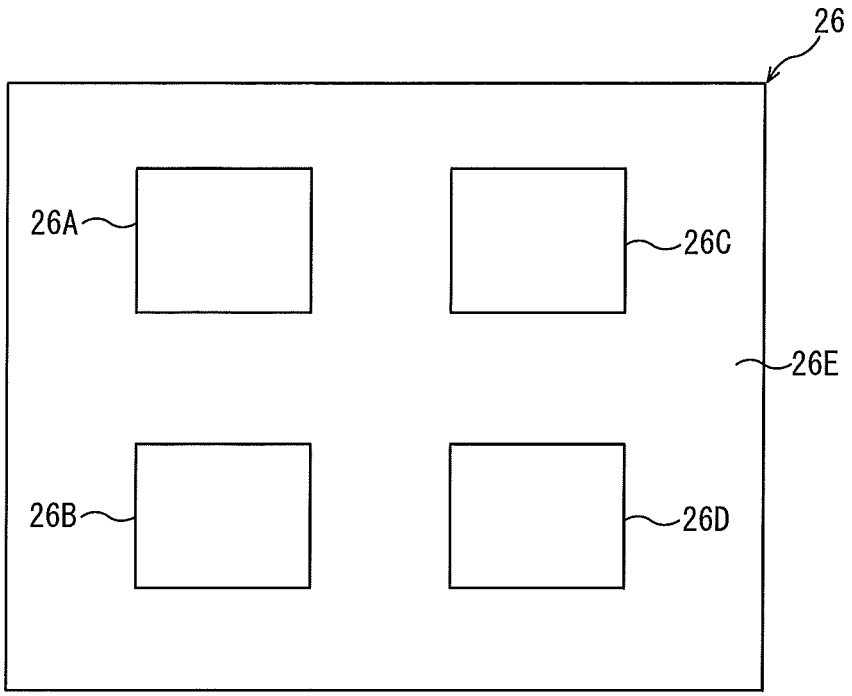
FIG. 24 illustrates an example application with a plurality of sub-regions.

The above embodiments describe implementations where the display region 26 is made up of four sub-regions 26A, 26B, 26C and 26D; alternatively, for example, as shown in FIG. 24, the display region 26 may include four sub-regions 26A, 26B, 26C and 26D and a remaining region 26E. In such implementations, the remaining region 26E may permanently display black, for example.

The invention claimed is:

1. A liquid crystal display device including a liquid crystal panel and displaying a video on the liquid crystal panel based on a video signal that has been received, wherein the liquid crystal panel includes a display region on which the video is displayed, the display region includes a plurality of sub-regions, and the liquid crystal display device further includes:

a drive unit configured to rewrite a display on at least one of the plurality of sub-regions based on the video signal;

an identification unit configured to identify one of the plurality of sub-regions on which the drive unit has not rewritten a display for a predetermined number of frames;

an output unit configured to output an interrupt signal for requesting a video signal for rewriting the display on the sub-region identified by the identification unit;

and the drive unit rewrites the display on the sub-region identified by the identification unit into a predetermined gray scale display if the display on the sub-region identified by the identification unit has not been rewritten in a predetermined number of frames since the output unit outputs the interrupt signal.

2. The liquid crystal display device according to claim 1, wherein the drive unit produces the predetermined gray scale display on the sub-region identified by the identification unit for a plurality of frames.

3. The liquid crystal display device according to claim 1, wherein the drive unit produces the predetermined gray scale display on the sub-region identified by the identification unit until it rewrites the display on the sub-region identified by the identification unit based on the video signal for rewriting the display on the sub-region identified by the identification unit.

4. The liquid crystal display device according to claim 1, wherein the drive unit produces the predetermined gray scale display on the sub-region identified by the identification unit until the liquid crystal display device is powered off.

5. The liquid crystal display device according to claim 1, wherein:

the liquid crystal panel further includes a plurality of pixel units forming the display region, each of the pixel units includes:

a thin-film transistor; and a storage capacitor connected to the thin-film transistor, the storage capacitor includes: a pixel electrode connected to the thin-film transistor; and a common electrode positioned adjacent the pixel electrode, the common electrode includes a plurality of common-electrode sections positioned to correspond to the plurality of sub-regions, and, if the drive unit has not rewritten the display on the sub-region identified by the identification unit in a predetermined number of frames since the output unit output the interrupt signal, the drive unit changes a potential of one of the plurality of common-electrode sections that corresponds to the sub-region identified by the identification unit and a potential of the pixel electrode contained in at least one of the plurality of pixel units that forms the sub-region identified by the identification unit to a predetermined potential.

6. The liquid crystal display device according to claim 1, wherein:

the liquid crystal panel further includes a plurality of pixel units forming the display region, each of the pixel units includes a thin-film transistor and a storage capacitor connected to the thin-film transistor, and the thin-film transistor includes a semiconductor layer made of an oxide semiconductor.

7. The liquid crystal display device according to claim 6, wherein the oxide semiconductor includes indium (In), gallium (Ga), zinc (Zn) and oxide (O).

8. The liquid crystal display device according to claim 7, wherein the oxide semiconductor is crystalline.

* * * * *